US009052675B2

(12) United States Patent
Takarada et al.

(10) Patent No.: US 9,052,675 B2
(45) Date of Patent: Jun. 9, 2015

(54) CARTRIDGE

(71) Applicant: CANON KABUSHIKI KAISHA, Tokyo (JP)

(72) Inventors: Hiroshi Takarada, Tokyo (JP); Akira Suzuki, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/718,294

(22) Filed: Dec. 18, 2012

(65) Prior Publication Data

US 2013/0170851 A1 Jul. 4, 2013

(30) Foreign Application Priority Data

Dec. 19, 2011 (JP) ..... 2011-277467

(51) Int. Cl.

| | |
|---|---|
| ***G03G 15/00*** | (2006.01) |
| ***G03G 21/16*** | (2006.01) |
| ***G03G 21/18*** | (2006.01) |
| ***G03G 15/08*** | (2006.01) |

(52) U.S. Cl.

CPC ..... *G03G 15/80* (2013.01); *G03G 21/1652* (2013.01); *G03G 21/181* (2013.01); *G03G 15/086* (2013.01); *G03G 21/1867* (2013.01)

(58) Field of Classification Search

CPC . G03G 15/80; G03G 21/1652; G03G 21/181; G03G 21/1867

USPC ..... 399/90

See application file for complete search history.

(56) References Cited

U.S. PATENT DOCUMENTS

| | | | |
|---|---|---|---|
| 5,966,567 | A | 10/1999 | Matsuzaki et al. |
| 6,144,815 | A | 11/2000 | Chadani et al. |
| 6,154,623 | A | 11/2000 | Suzuki et al. |
| 6,173,140 | B1 | 1/2001 | Suzuki et al. |
| 6,173,145 | B1 | 1/2001 | Chadani et al. |
| 6,205,305 | B1 | 3/2001 | Suzuki et al. |

(Continued)

FOREIGN PATENT DOCUMENTS

| | | |
|---|---|---|
| JP | 2000-112315 | 4/2000 |
| JP | 2005-215311 | 8/2005 |

(Continued)

OTHER PUBLICATIONS

International Search Report and Written Opinion in International Patent Application No. PCT/JP2012/083757, dated Jun. 19, 2013.

*Primary Examiner* — David Gray
*Assistant Examiner* — Michael Harrison
(74) *Attorney, Agent, or Firm* — Fitzpatrick, Cella, Harper & Scinto

(57) ABSTRACT

According to an aspect of the present invention, there is provided a cartridge detachably mountable to a main assembly of an image forming apparatus, comprising an electric energy receiving member; a frame of resin material; an electrode member which is molded by injecting electroconductive resin material into the frame which provides an electroconductive path between the electric energy receiving member and a main assembly electrical contact provided in the main assembly when the cartridge is mounted to the main assembly, the electrode member having a projected portion projected from a surface of the frame for contacting the main assembly electrical contact, the projected portion being provided by changing a direction of flow of the injected electroconductive resin material by the metal mold or the frame.

16 Claims, 18 Drawing Sheets

(56) References Cited

U.S. PATENT DOCUMENTS

| | | | | |
|---|---|---|---|---|
| 6,219,504 | B1 | 4/2001 | Matsuzaki et al. | |
| 6,246,853 | B1 | 6/2001 | Suzuki et al. | |
| 6,282,389 | B1 | 8/2001 | Matsuzaki et al. | |
| 6,415,121 | B1 | 7/2002 | Suzuki et al. | |
| 6,549,736 | B2 | 4/2003 | Miyabe et al. | |
| 6,654,578 | B2 | 11/2003 | Suzuki et al. | |
| 6,771,920 | B2 | 8/2004 | Abe et al. | |
| 6,795,666 | B2 | 9/2004 | Miyabe et al. | |
| 6,868,243 | B2 | 3/2005 | Watanabe et al. | |
| 6,931,226 | B2 | 8/2005 | Chadani et al. | |
| 6,934,485 | B2 | 8/2005 | Miyabe et al. | |
| 7,099,607 | B2 | 8/2006 | Suzuki et al. | |
| 7,366,439 | B2 | 4/2008 | Anan et al. | |
| 7,933,534 | B2 | 4/2011 | Hoshi et al. | |
| 8,155,553 | B2 | 4/2012 | Takarada | |
| 8,249,485 | B2 | 8/2012 | Horikawa et al. | |
| 2001/0026701 | A1 | 10/2001 | Sasaki et al. | |
| 2009/0290904 | A1 | 11/2009 | Kawai et al. | |
| 2011/0170903 | A1 | 7/2011 | Hoshi et al. | |
| 2013/0022368 | A1* | 1/2013 | Takarada et al. | 399/110 |
| 2013/0114972 | A1* | 5/2013 | Takarada et al. | 399/110 |
| 2013/0121720 | A1 | 5/2013 | Hoshi et al. | |
| 2013/0129375 | A1 | 5/2013 | Yamasaki et al. | |
| 2013/0129377 | A1 | 5/2013 | Satomura et al. | |

FOREIGN PATENT DOCUMENTS

| | | |
|---|---|---|
| JP | 2007-47491 | 2/2007 |
| JP | 2008-292557 | 12/2008 |

* cited by examiner (a)

(b)

(a)

(b)

(c)

(a)

(b)

(a)

(b)

(a)

(b)

CARTRIDGE

FIELD OF THE INVENTION AND RELATED ART

The present invention relates to a cartridge removably installable in the main assembly of an electrophotographic image forming apparatus.

A cartridge system has been in use for quite sometime. It integrally places a photosensitive drum and one or more means for processing the photosensitive drum, in a cartridge which is removably installable in the main assembly of an electrophotographic image forming apparatus. Thus, as a cartridge is properly situated in the main assembly of an image forming apparatus, the electrodes of the main assembly of the image forming apparatus are in contact with the electrical contacts of the cartridge to provide electrical connection between the photosensitive drum(s), processing means, etc., which need to be supplied with electric power from the main assembly, remain electrically in contact with the main assembly, making it possible to charge the photosensitive drum(s) and developer bearing member(s), keep the photosensitive drum(s) grounded, electrostatically measure the residual amount of toner in the main assembly, and the like processes.

One of the patent applications in which such system as the one described above is disclosed is Japanese Laid-open Patent Application 2007-47491.

As a method for providing a cartridge with electrical contacts (electrodes), it is possible to form the electrical contacts as integral parts of the processing means supporting portion (frame) of the cartridge, by injecting electrically conductive resin (resin which contains electrically conductive substance) in the space between the processing means supporting portion (frame) and an electrical contact formation mold placed in contact with the processing means supporting portion (frame). It is also possible to form the electrical contacts as integral parts of the processing means supporting portion (frame) of a process cartridge, with the use of such a two color injection molding that injects the resin of the first color, or the material for the processing means supporting portion (frame), into the mold for the supporting portion (frame), and then, injecting the resin of the second color, or the material for the electrical contacts.

In a case where the electrical contacts are formed of electrically conductive resin, the resin is desired to be as small as possible in electrical resistance.

SUMMARY OF THE INVENTION

The present invention was made in consideration of the above-described issues. Thus, the primary object of the present invention is to provide a cartridge, the electrical contacts of which are made of electrically conductive resin, and are significantly smaller in electrical resistance than any electrical contact made for a cartridge, which is in accordance with the prior art.

According to an aspect of the present invention, there is provided a cartridge detachably mountable to a main assembly of an image forming apparatus, comprising an electric energy receiving member; a frame of resin material; an electrode member which is molded by injecting electroconductive resin material into said frame which provides an electroconductive path between said electric energy receiving member and a main assembly electrical contact provided in the main assembly when said cartridge is mounted to the main assembly, said electrode member having a projected portion projected from a surface of said frame for contacting said main assembly electrical contact, said projected portion being provided by changing a direction of flow of the injected electroconductive resin material by said metal mold or said frame.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 12(*c*)-12(*f*) are sectional view of various portions of the contact.

FIG. 12 is for describing the functions of various portion of the electrical contact.

DESCRIPTION OF THE PREFERRED EMBODIMENTS

Hereinafter, the embodiments of the present invention are described in detail with reference to the appended drawings. However, the measurement, material, and shape of the structural components of the process cartridges in the following embodiments of the present invention, and the positional relationship among the structural components, etc., are not intended to limit the present invention in scope. That is, the present invention is also applicable to cartridges different in structure and/or various settings from those in the following embodiments.

The present invention relates to a cartridge removably installable in the image assembly of an electrophotographic image forming apparatus. Here, an "electrophotographic image forming apparatus" is an apparatus for forming an image on recording medium with the use of an electrophotographic image forming process. Some of the examples of an electrophotographic image forming apparatus are an electrophotographic copying machine, an electrophotographic printer (laser beam printer, LED printer, etc.), a facsimile apparatus, and a word processor. A "cartridge" is a general term for a process cartridge made up of a drum supporting frame for supporting an electrophotographic photosensitive drum (electrophotographic photosensitive member), a development roller supporting frame for supporting a developing means, an electrophotographic photosensitive drum, drum processing means, and a shell (cartridge) in which the preceding components are integrally placed. The processing means are means for processing the electrophotographic photosensitive drum. Some of the examples of the processing means are the charging means, developing means, and cleaning means which act on the electrophotographic drum, and also, a toner supply roller for coating the peripheral surface of the developer bearing member (development roller) with toner, a means for detecting the amount of toner remaining in a cartridge, and the like.

[Embodiment 1]

First, the electrophotographic image forming apparatus (which will be referred to simply as image forming apparatus, hereafter) in this embodiment is described about its structural components, in particular, the structure of the electrical contacts (which hereafter may be referred to simply as contacts) of the drum supporting frame of the cartridge, and the method for forming the electrical contacts.

(1) Image Forming Apparatus

Figure 2:
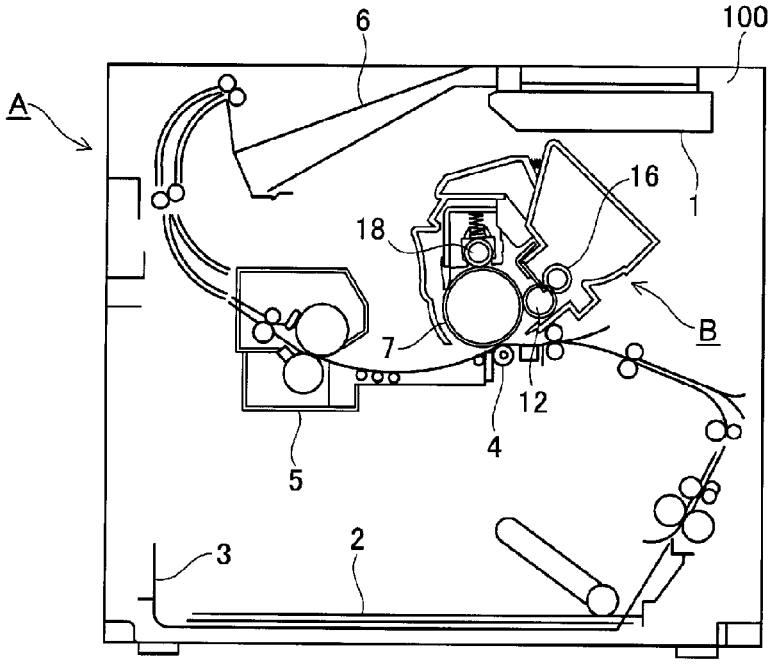
FIGS. 2(*a*) and 2(*b*) are schematic sectional views of the image forming apparatus and process cartridge, respectively, in the first embodiment of the present invention, at a plane parallel to the recording medium conveyance direction of the apparatus.
Figure 2:
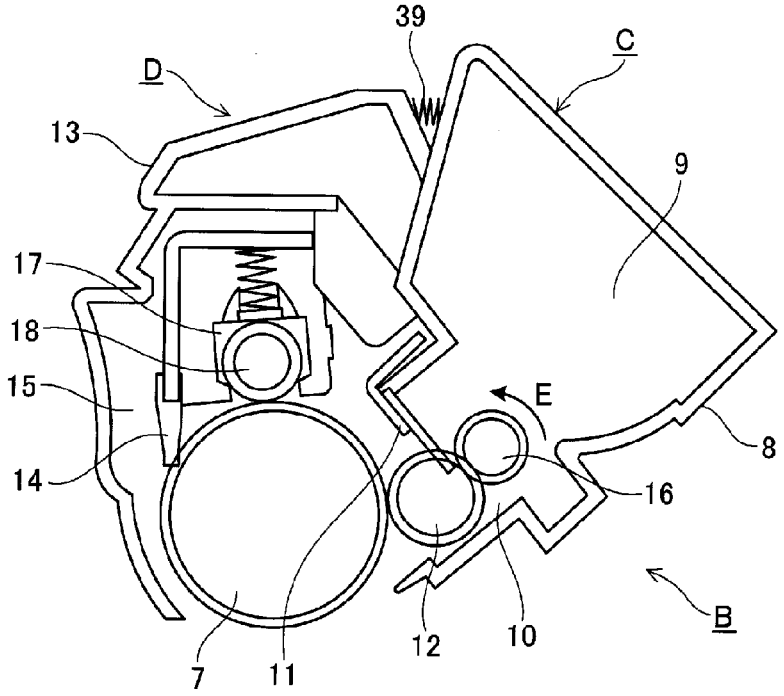

To begin with, referring to FIG. 2, the image forming apparatus A in this embodiment is described. FIG. 2(*a*) is a schematic sectional view of the image forming apparatus A (laser beam printer), which includes a process cartridge B. It shows the general structure of the apparatus A.

The formation of an image on a sheet 2 of recording medium by the image forming apparatus A shown in FIG. 2(*a*) is as follows: First, the beam of laser light is projected upon the electrophotographic photosensitive drum 7 (which hereafter will be referred to simply as photosensitive drum) from an optical system 1 while being modulated with the information about the image to be formed, whereby an electrostatic latent image is formed on the photosensitive drum 7. This latent image is developed by developer (which will be referred to as toner), into a visible image, that is, an image formed of toner. Meanwhile the sheet 2 of recording medium is pulled out of a sheet feeder cassette 3, and is conveyed to where a transfer roller 4 is located, in synchronism with the progression of the formation of the toner image on the photosensitive drum 7. Then, the toner image formed on the photosensitive drum 7 is transferred onto the sheet 2 of recording medium. Thereafter, the toner image on the sheet 2 is fixed to the sheet 2 by the heat and pressure applied thereto by a fixing means 5. Finally, the sheet 2 is discharged into a delivery tray 6.

(2) Process Cartridge

Next, referring to FIGS. 2(*a*) and 2(*b*), the process cartridge B is described. FIG. 2(*b*) is a sectional view of the process cartridge B in this embodiment. It shows the general structure of the process cartridge B.

The process cartridge B is a combination of a development section C and a latent image forming section D. The two sections C and D are connected to each other so that they are allowed to pivotally move relative to each other. The process cartridge B is removably installable in the main assembly 100 of the image forming apparatus A. The development section C has a developing means and a development roller supporting frame 8. The developing means is made up of a development roller 12, a toner supply roller 16, etc. The development roller supporting frame 8 supports the abovementioned developing means, and also, stores toner. The latent image forming section D is made up of such structural components as the photosensitive drum 7 and a cleaning blade 14, etc., and a drum supporting frame 13 for supporting these structural components.

The toner stored in the toner storage 9 of the development section C is conveyed to a development chamber 10, in which the development roller 12, toner supply roller 16, and development blade are present, which are arranged in such a manner that the peripheral surface of the toner supply roller 16 and the toner layer regulating edge of the development blade 11 are in contact with the peripheral surface of the development roller 12. Thus, as the toner supply roller 16 is rotated in the direction indicated by an arrow mark E in FIG. 2(*b*), a layer of toner is formed on the peripheral surface of the development roller 12. As the toner particles in the toner layer on the peripheral surface of the development roller 12 are transferred onto the peripheral surface of the photosensitive drum 7, in the pattern of the latent image on the peripheral surface of the photosensitive drum 7, an image is formed of the toner particles, on the peripheral surface of the photosensitive drum 7.

After the transfer of the toner image on the photosensitive drum 7 onto the sheet 2 of recording medium by the transfer roller 4, the toner remaining on the peripheral surface of the photosensitive drum 7 is scraped down by the cleaning blade 14, to be stored in (removed into) a waste toner storage chamber. Thereafter, the peripheral surface of the photosensitive drum 7 is uniformly charged by the charge roller, as charging means (processing means), being readied for the latent image formation by the optical system 1.

(3) Latent Image Forming Section

Figure 3:
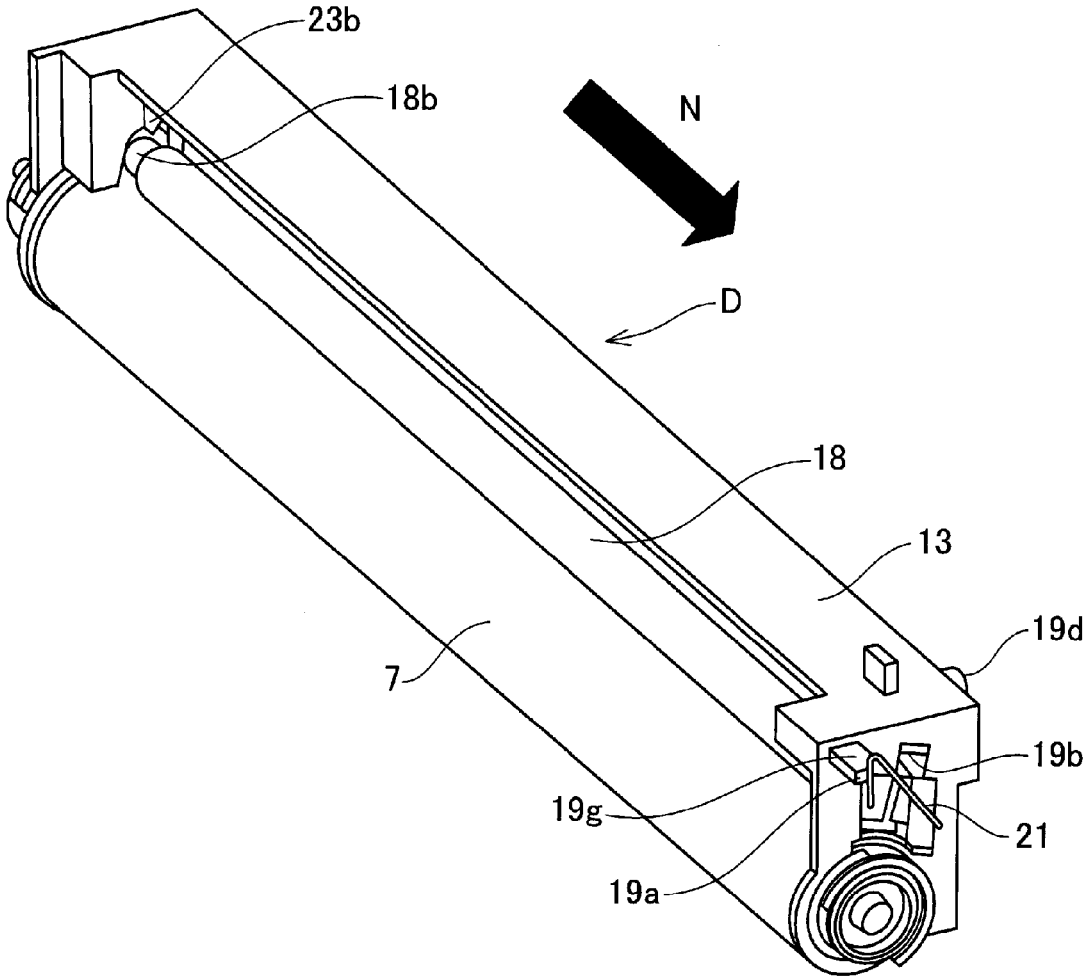
FIG. 3 is a perspective view of the combination of the drum and drum supporting frame (sub-frame) of the process cartridge in the first embodiment, and shows the general structure of the combination.
Figure 4:
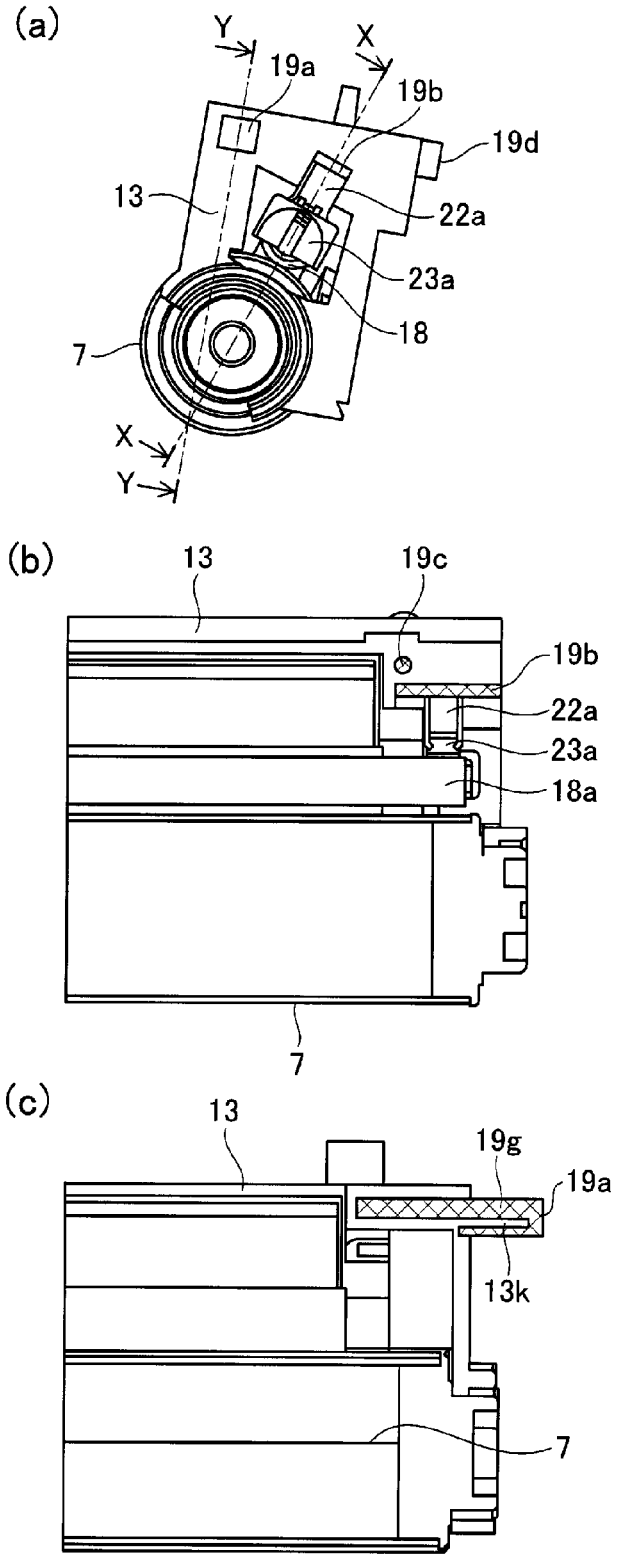
FIGS. 4(*a*)-4(*c*) are side views of the electrical contact and its adjacencies of the combination of the drum and drum supporting frame (sub-frame) of the process cartridge in the first embodiment, FIGS. 5(*a*)-5(*e*) are schematic drawings of the drum supporting frame (sub-frame) of the process cartridge in the first embodiment, prior to the injection of the electrically conductive resin.

Next, referring to FIGS. 2(*b*), 3 and 4, the latent image forming section of the process cartridge B is described about its general structure. FIG. 3 is a perspective view of the latent image forming section D, in particular, the portions involved in the charging process, of the process cartridge B, when the process cartridge B is in the main assembly 100 of the image forming apparatus A. FIG. 4(*a*) is a side view (as seen from downstream side of arrow mark N in FIG. 3) of the lengthwise end portion of the section D of the process cartridge B, which has the electrical contact for the photosensitive drum 7. FIG. 4(*b*) is a sectional view of the portion of the latent image forming section D in FIG. 4(*a*), at a plane which coincides with a line Y-Y in FIG. 4(*a*). It shows the electrical contact and its adjacencies.

Referring to FIGS. 3 and 4, the charge roller 18 for charging the peripheral surface of the photosensitive drum 7 is rotatably supported by the lengthwise end portions of its axle, by a pair of charge roller terminals 23*b* and 23*a* made of an electrically conductive substance (electrically conductive resin, for example). In FIGS. 3 and 4, the lengthwise end portions of the axle of the charge roller 18 are designated by referential codes 18*a* and 18*b*, one for one. Hereafter, they will be referred to as the metallic core end portions 18*a* and 18*b* of the charge roller 18. The charge roller terminals 23*a* and 23*b* are provided with a pair of electrically conductive compression springs 22*a* and 23*b*, one for one. Further, the charge roller terminals 23*a* and 23*b* are attached to the drum supporting frame 13 in such a manner that the compression springs 22*a* and 22*b* remain compressible. That is, the charge roller 18 is indirectly supported by the drum supporting frame 13. Next, referring to FIG. 4(*b*), as the photosensitive drum 7 and charge roller 18 are pressed upon each other, the compression springs 22*a* and 22*b* are compressed, and therefore, the charge roller 18 is kept pressed upon the photosensitive drum 7 by a preset amount of pressure generated by the resiliency of the compression springs 22*a* and 22*b*.

Figure 13:
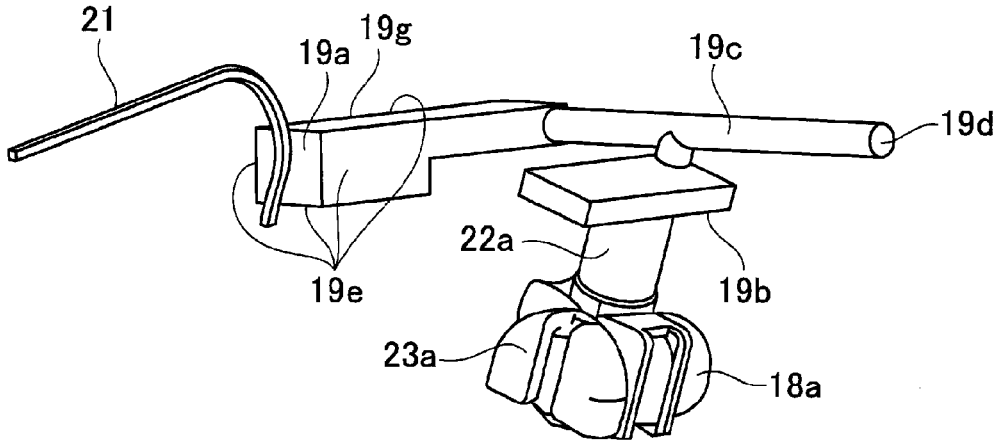
FIGS. 13(*a*) and 13(*b*) are perspective views of the combination of the electrode of the main assembly of the image forming apparatus and the compression spring and charge roller terminal of the process cartridge, in the first embodiment. They correspond to FIGS. 12(*a*) and 12(*b*).
Figure 13:
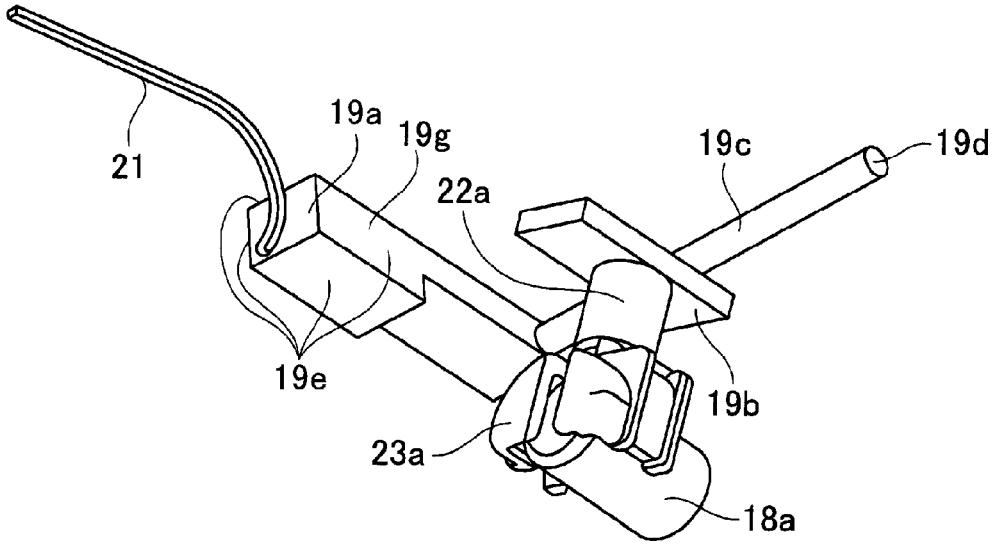
Figure 14:
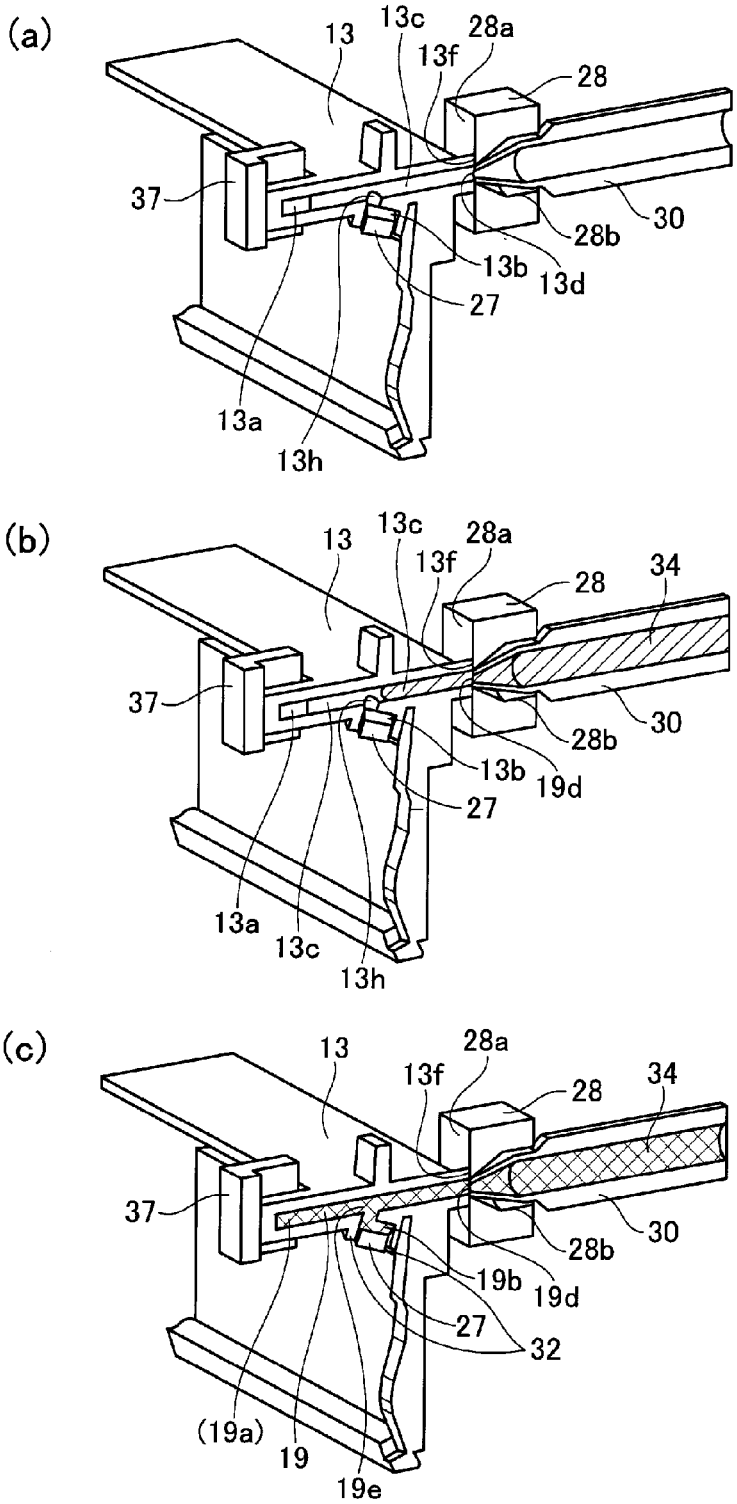
FIG. 14 is a drawing for describing the sequential steps through which the electrically conductive resin is injected into the space formed between the drum supporting frame (sub-frame) of the process cartridge, and the electrical contact formation mold, in the first embodiment.

(4) Structure of Electrical Contact of Latent Image Forming Section of Process Cartridge, and Method for Applying Voltage to Charge Roller Next, referring to FIGS. 3, 4 and 13, the method for charging the photosensitive drum 7 is described. Referring to FIGS. 3 and 4, an electrical contact 19 is an integral part of the drum supporting frame 13. The method for forming the electrical contact 19 will be concretely described in Section 8 of this document. Roughly speaking, the electrical contact 19 is formed by injecting electrically conductive resin 34 (resin which contains electrically conductive substance) into a space (gap) which is formed between the drum supporting frame 13 and a pair of molds 27 and 28, as the molds 27 and 28 are attached to the drum supporting frame 13 (FIG. 14).

As described above, the electrical contact 19, which is the electrical contact of the latent image forming section of the process cartridge B, is molded of electrically conductive resin, by the injection of the electrically conductive resin into the space between the drum supporting frame 13, and the pair of molds 27 and 28 attached to the frame 13. As the process cartridge B is installed into the main assembly 100 of the image forming apparatus A, the electrical contact 19 becomes an electricity passage which connects between the electrode (electrical contact) 21 of the main assembly 100 and the charge roller 18. Here, it is the charge roller 18 that is electrically connected to the electrode 21 with which the main assembly 100 of the image forming apparatus A is provided. FIG. 13 is a drawing of the electrical contact 19, electrode 21 (as electrical contact of main assembly 100), compression spring 22*a*, and charge roller electrode 23*a*, which will be described in Section (9). The electrical contact 19 has the first and second points of contact (which will be referred to as charge roller contact point 19*b* and contacting surface 19*a* (main assembly contacting point), respectively).

As will be described later in Section (9), the electrical contact 19 has a protrusion 19*g*, the contacting surface 19*a* (as electrical contact of cartridge), a charge roller contact point 19*b*, a runner section 19*c*, and a gate 19*d*. The charge roller contact point 19*b* branches from the runner section 19*c*. The contacting surface 19*a* and charge roller contact point 19*b* are in connection to each other through the runner section 19*c*. They are integral parts of the electrical contact 19. The projection 19*g* is on the outward surface of the downstream side wall of the drum supporting frame 13 (end wall in terms of direction parallel to axle of photosensitive drum 7) (with reference to direction of arrow mark N in FIG. 3). The contacting surface 19*a* is at the end of the projection 19*g*.

As the process cartridge B is installed into the main assembly 100 of the image forming apparatus A, the electrode 21 of the main assembly 100 comes into contact with the contacting surface 19*a* of the electrical contact 19 which is an integral part of the drum supporting frame 13. As for the point 19*b* of contact for the charge roller 18, which serves as the seat for the compression spring 22*a* (which is electrically conductive), it is in contact with the compression spring 22*a*, providing electrical connection between the compression spring 22*a* and electrical contact 19.

After the installation of the process cartridge B into the main assembly 100 of the image forming apparatus A, voltage is applied to the electrode 21 of the main assembly 100 in response to a command from the controller section (unshown) of the main assembly 100. Thus, voltage is applied to the peripheral surface of the charge roller 18 (as drum charging member) by way of the contacting surface 19*a*, runner section 19*c*, charge roller contact point 19*b*, compression spring 22*a*, charge roller terminal 23*a* (formed of electrically conductive resin), and metallic core 18*a* of the charge roller 18. Consequently, the peripheral surface of the photosensitive drum 7 is uniformly charged by the charge roller 18. That is, the electrical contact 19 is for establishing electrical connection between the charge roller 18 and main assembly electrode 21.

In this embodiment, the main assembly electrode 21 is directly connected to the electrical contact 19. However, they may be indirectly connected to each other, with the placement of an electrically conductive member between the two. Further, the electrical contact 19 and charge roller 18 are electrically in contact with each other through the charge roller terminal 23*a* and compression spring 22*a*. However, the process cartridge B may be structured so that the electrical contact 19 is directly in contact with the charge roller 18.

Further, in this embodiment, the electrical contact 19 is for charging the photosensitive drum 7. However, this embodiment is not intended to limit the present invention in terms of the usage of the electrical contact 19. That is, the present invention is also applicable to any electrical contact for a process cartridge. For example, it is applicable to an electrical contact for supplying the development roller (as developing means) and toner supply roller 16 with electrical power, an electrical contact for connecting the process cartridge B with the drum ground (unshown), an electrical contact for supplying the circuit (unshown) for detecting the amount of the residual toner in the process cartridge B, and the like.

(5) Drum Supporting Frame

Figure 5:
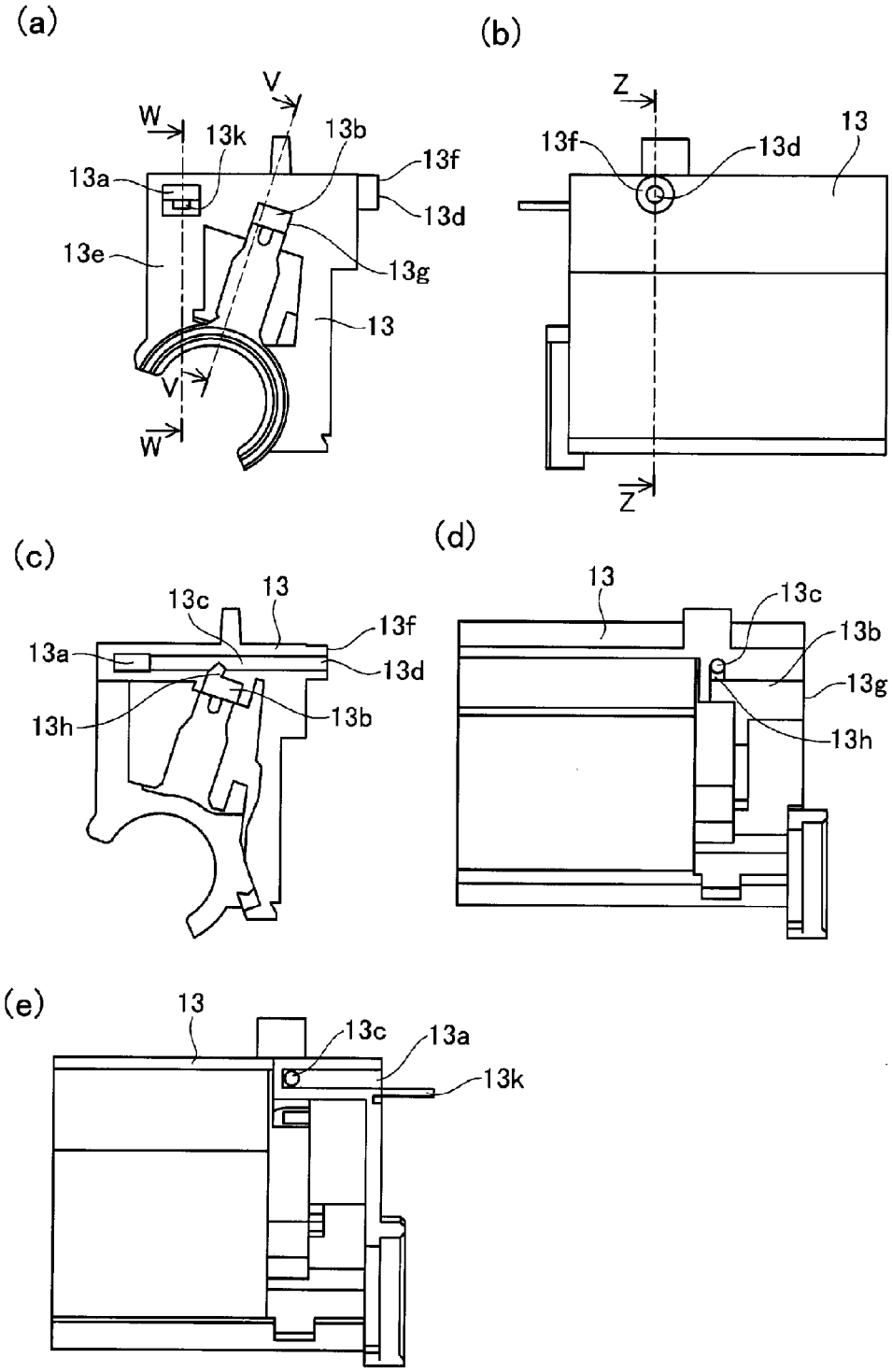
Figure 15:
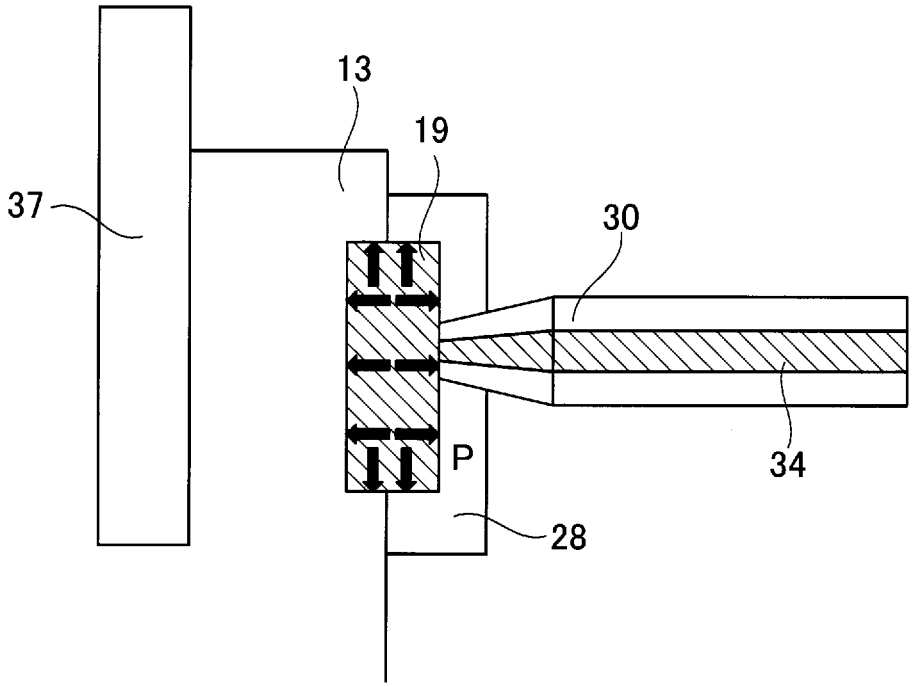
FIG. 15 is a drawing for describing the resin pressure in the first embodiment.

Next, referring to FIGS. 4 and 5, the shape of the drum supporting frame 13 is described. FIG. 5 shows the shape of the drum supporting frame 13 before the injection of the electrically conductive resin 34. More specifically, FIG. 5(*a*) is a side view of the lengthwise end of the drum supporting frame 13, which is going to have the electrical contact 19 (as seen from the downstream side, in terms of direction indicated by arrow mark N in FIG. 3. FIG. 5(*b*) is an external view of the lengthwise end portion of the drum supporting frame 13, shown in FIG. 5(*a*), as seen from its side having the resin injection opening (gate) 13*d* of the drum supporting frame 13 (right side view as seen from same direction as direction from which drum supporting frame 13 is seen in FIG. 15(*a*)). FIG. 5(*c*) is a sectional view of the drum supporting frame 13 at a plane which coincides with a line Z-Z in FIG. 5(*b*). FIG. 5(*d*) is a sectional view of the drum supporting frame 13 at a plane which coincides with a line V-V in FIG. 5(*a*). FIG. 5(*e*) is a sectional view of the drum supporting frame 13 at a plane which coincides with a line W-W in FIG. 5(*a*).

Referring to FIGS. 5(*a*) and 5(*c*), the drum supporting frame 13 has: a surface 13*a* for forming the contacting surface 19*a*; a surface 13*b* for forming the charge roller contact point 19*b*, which functions as the seat for the compression spring 22*a*; and a mold insertion hole 13*g*.

Further, it has: surfaces 13*e* and 13*f*, with which the molds 27 and 28 are placed in contact when the contacting surface 19*a* and charge roller contact point 19*b* are molded. Further, it has: a resin injection hole 13*d*, through which the electrically conductive resin 34 is injected; and a rib 13*k*, which projects into the electrical contact formation space from the surface 13*a* for forming the contacting surface 19*a* of the electrical contact 19, on the downstream side in terms of the resin flow. Further, it has a runner 13*c* (through which electrically conductive resin 34 is guided into its destinations), which is in the form of a tunnel. The runner 13*c* (tunnel) branches at a point 13*h*, into a passage (runner) which leads to the surface area 13*a* for forming the contacting surface 19*a* of the electrical contact 19, and the surface area 13*b* for forming the charge roller contact point 19*b*.

(6) Mold for Forming Contacting Surface of Electrical Contact

Figure 6:
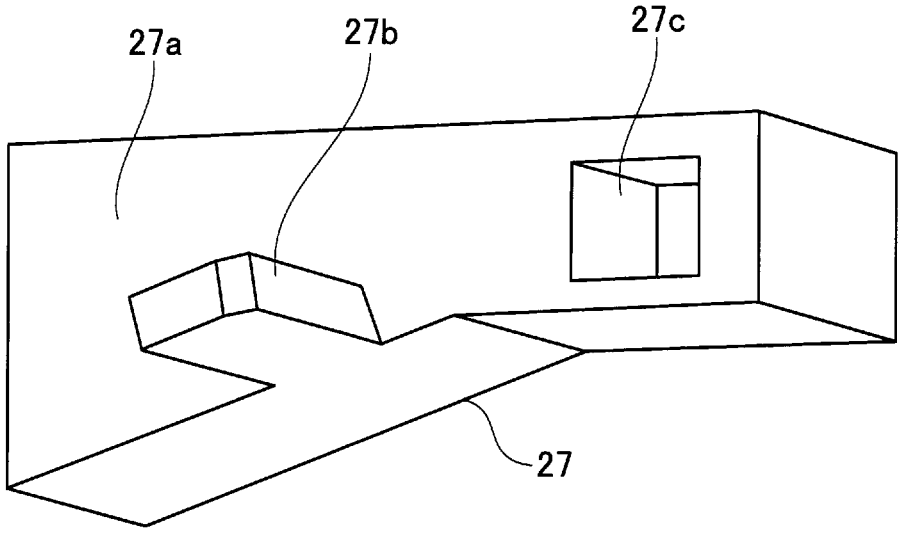
FIG. 6 is a schematic perspective view of the mold to be placed in contact with the drum supporting frame (sub-frame) of the process cartridge, to form the electrical contact, in the first embodiment, as seen from the inward side of the mold.
Figure 10:
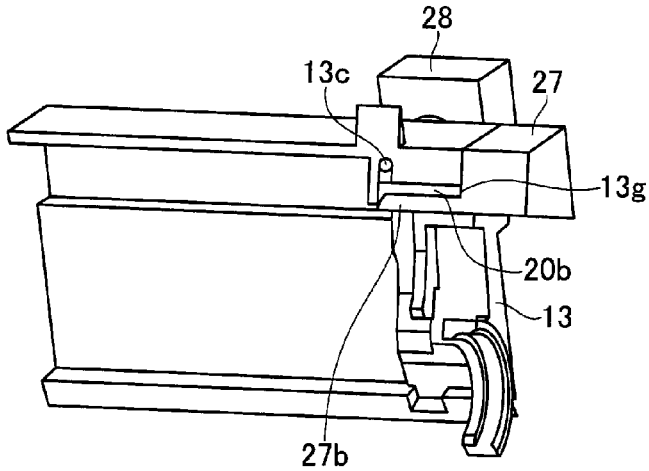
FIG. 10 is a drawing for describing the electrical contact for the charge roller in the first embodiment.
Figure 10:
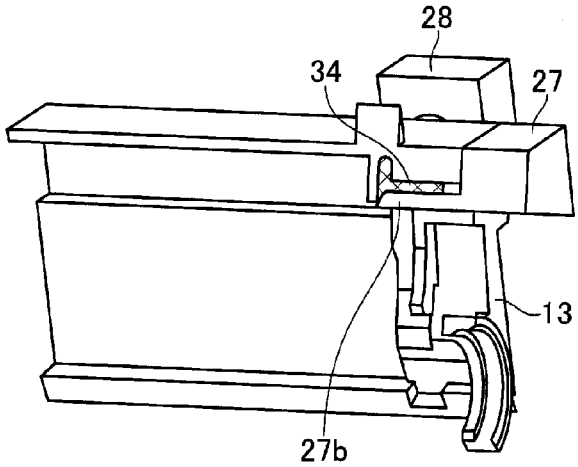
Figure 10:
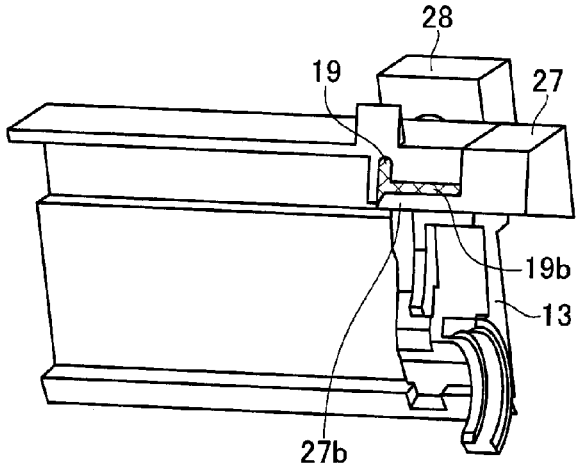

Next, referring to FIGS. 5, 6, 10 and 11, the mold for forming the contacting surface 19*a* of the electrical contact 19 is described. FIG. 6 is a drawing of one (mold 27) of the two molds which are placed in contact with the drum supporting frame 13 to form the electrical contact 19. FIG. 10 is a schematic drawing for describing the sequential steps through which the charge roller contact point 19*b* is formed by the injection of the electrically conductive resin 34 into the space formed by placing the mold 27 in contact with the drum supporting frame 13. More specifically, FIG. 10(*a*) is a schematic perspective view of the combination of the drum supporting frame 13 (partially broken), mold 27, and mold 28 after the formation of a spring seat formation space 20*b*, by the placement of the mold 27 in contact with the drum supporting frame 13. FIG. 10(*b*) is a schematic perspective view of the combination of the drum supporting frame 13 (partially broken), mold 27, and mold 28 after the electrically conductive resin 34 has begun to flow into the spring seat formation space 20*b* through the tunnel-like runner 13*c*. FIG. 10(*c*) is a schematic perspective view of the combination of the drum supporting frame 13 (partially broken), mold 27, and mold 28 after the completion of the injection of the spring seat formation space 20*b*, that is, after the completion of the formation of the charge roller contact point 19*b*.

Figure 11:
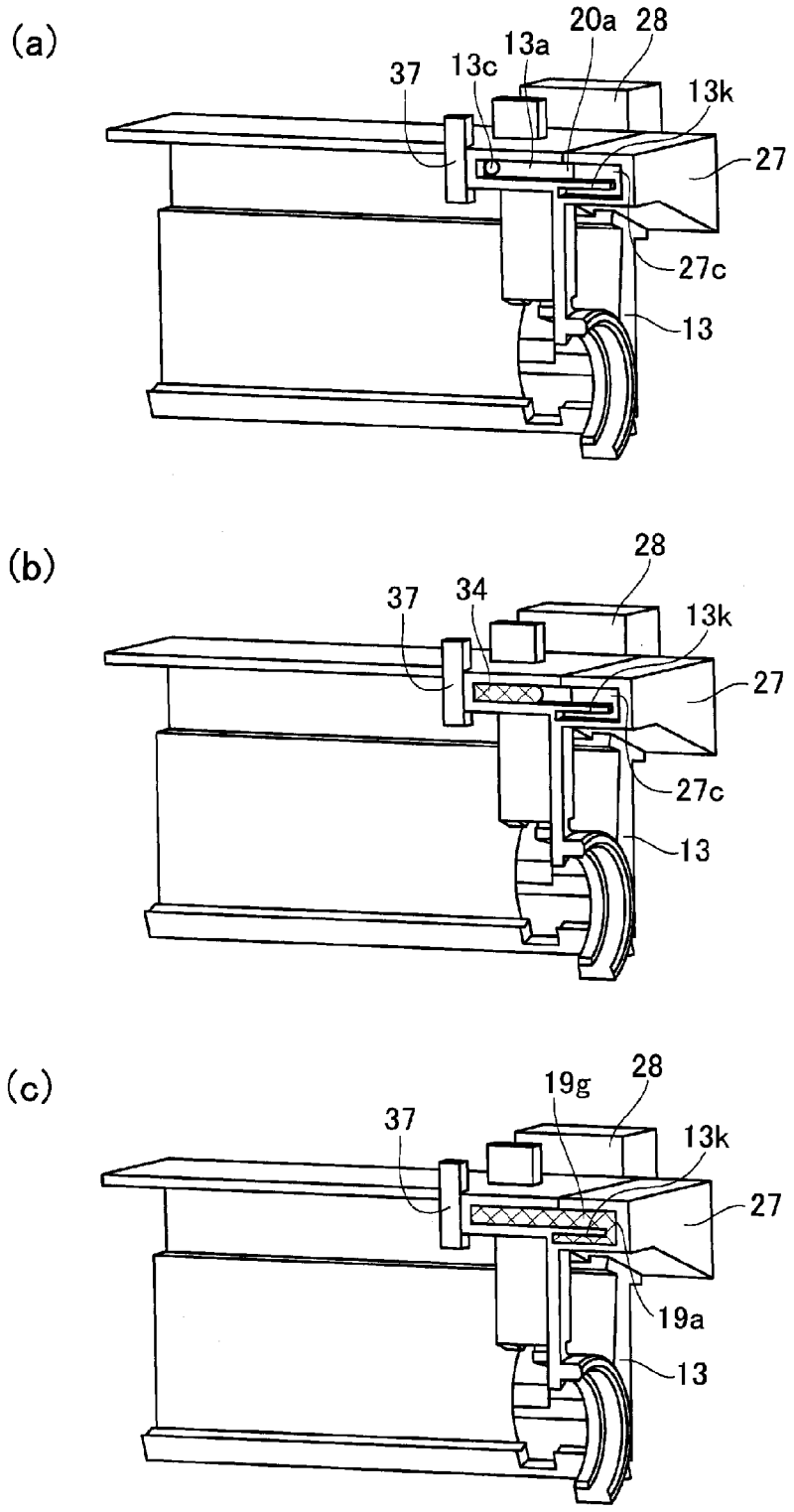
FIG. 11 is a drawing for describing the area of contact of the electrical contact of the process cartridge, in the first embodiment, by which the main assembly electrode is contacted.

FIG. 11 is a schematic drawing for describing the contacting surface 19*a*, which is formed as the electrically conductive resin 34 is injected into the electrical contact formation space created between the drum supporting frame 13 and mold 27 as the mold 27 is joined with the drum supporting frame 13. As the electrically conductive resin 34 is injected into the electrical contact formation space, the electrical contact 19 is formed, with the rib 13*k* remaining inserted into the electrical contact formation space 27*c* (which will be referred to simply as recess 27*c*). FIG. 11(*a*) is a schematic perspective view of the combination of the drum supporting frame 13 (partially broken), mold 27, and mold 28 after the attachment of the mold 27 to the drum supporting frame 13 in such a manner that the electrical contact formation space 13*a* of the drum supporting frame 13 becomes connected to the recess 27*c* of the mold 27 to create the electrical contact formation space 20*a*. FIG. 11(*b*) is a schematic perspective view of the combination of the drum supporting frame 13 (partially broken), mold 27, and mold 28 after the electrically conductive resin 34 has begun to flow into contacting surface formation space 20*a* through the tunnel-shaped runner 13*c*. FIG. 11(*c*) is a schematic perspective view of the combination of the drum supporting frame 13 (partially broken), mold 27, and mold 28 after the envelopment of the rib 13*k* by the electrically conductive resin 34, and completion of the contacting surface 19*a*.

Referring to FIG. 6, the mold 27, which is for forming the electrical contact 19, has a surface 27*a*, a recess 27*c*, and a projection 27*b* (mold projection). The surface 27*a* meets the mold facing surface 13*e* of the drum supporting frame 13. The recess 27*c* is such a portion of the mold 27 that becomes a part of the electrical contact formation space 20*a*, in particular, the contacting surface 19*a*. The projection 27*b* is for forming the charge roller contact point 19*b*, which functions as the seat for the compression spring 22*a* inserted into the mold insertion hole 13*g*.

(7) Resin Injection Gate Mold

Figure 7:
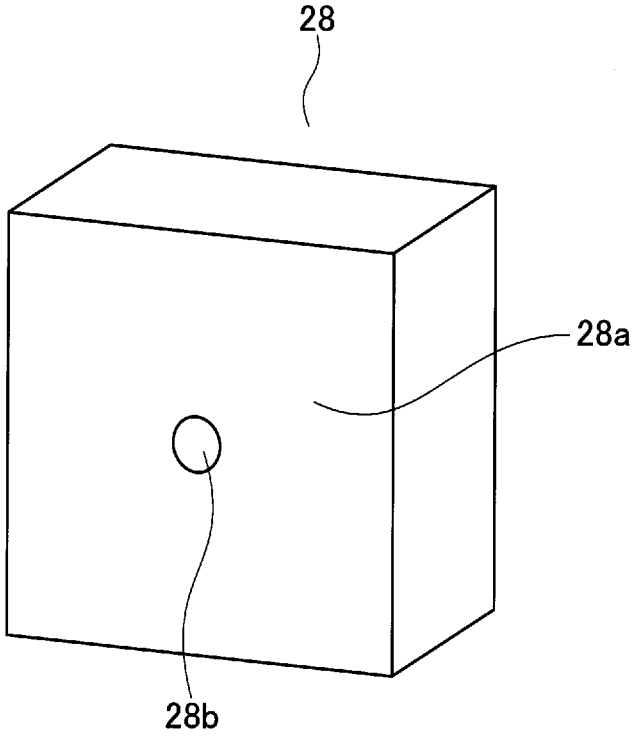
FIG. 7 is a schematic perspective view of the mold to be placed in contact with the drum supporting frame (sub-frame) of the process cartridge, to form the electrical contact, in the first embodiment, as seen from the outward side of the mold.

Next, referring to FIGS. 4, 7 and 14, the mold 28, which is the other of the two molds described in Section (6) is described. The mold 28 is the mold, through which the electrically conductive resin 34 is injected into the electrical contact formation space 20*a* to form the electrical contact 19. FIGS. 14(*a*), 14(*b*) and 14(*c*) are schematic perspective/sectional views of the combination of the drum supporting frame 13 (partially broken), mold 28, and gate 30, at a vertical plane which coincides with the axial line of the gate 30. They sequentially describe the process of forming the electrical contact 19, from when the mold 28 was joined with the drum supporting frame 13 to when the injection of the electrically conductive resin 34 into the electrical contact formation space 20*a* is completed. FIG. 7 is a drawing of the other (mold 28) of the two molds, described in Section (6), which are placed in contact with the drum supporting frame 13 to form the electrical contact 19. The mold 28 has: a surface 28*a*, which is to be placed in contact with the surface 13*f* of the drum supporting frame 13; and a hole 28*b* into which the gate 30 for injecting the electrically conductive resin 34 is to be fitted.

(8) Method for Forming Electrical Contact

Figure 8:
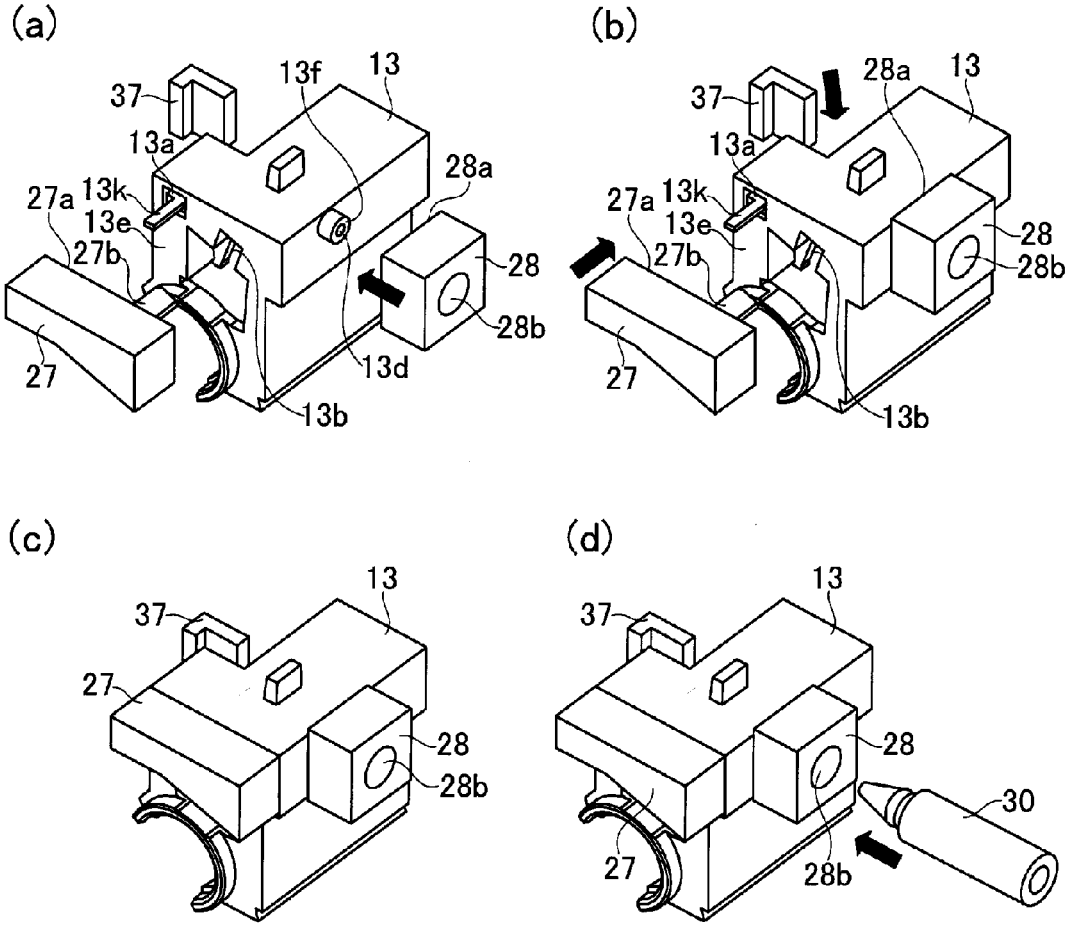
FIGS. 8(*a*)-8(*d*) are drawings for showing the sequential steps through which the molds for the formation of the electrical contact are attached to the drum supporting frame (sub-frame) of the process cartridge in the first embodiment.
Figure 9:
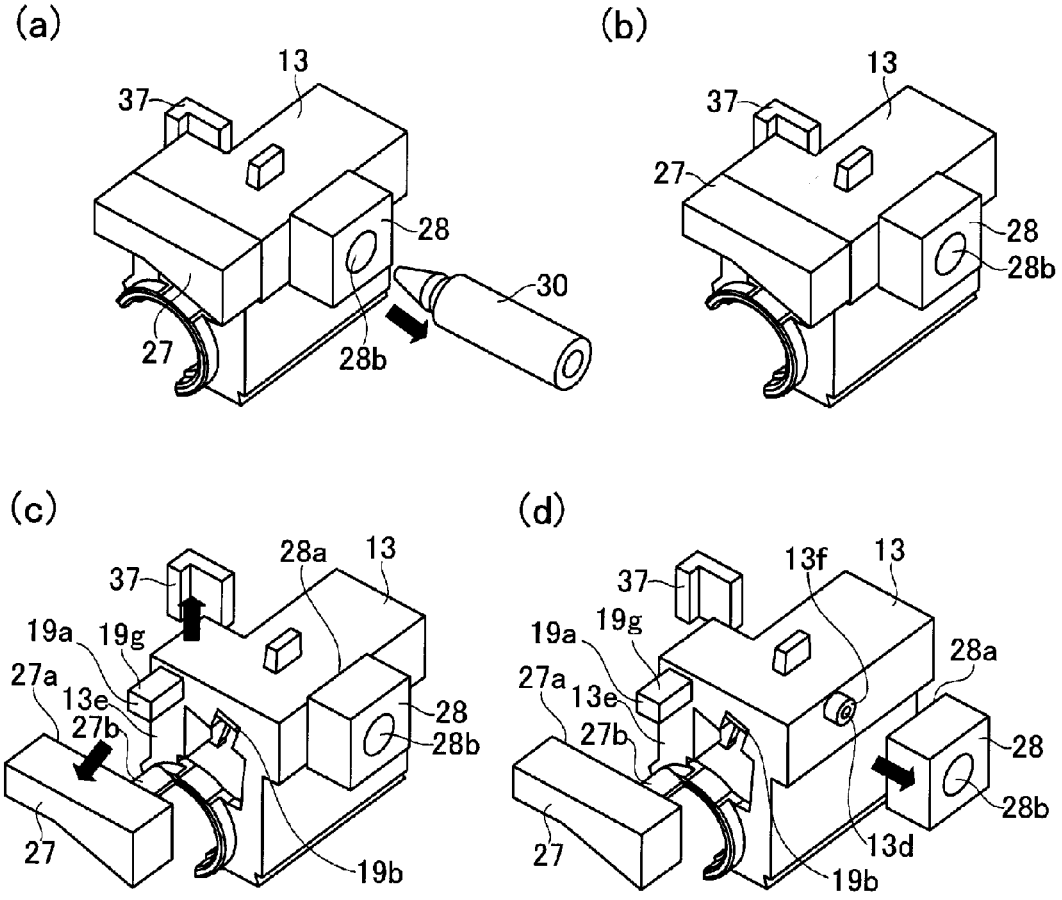
FIGS. 9(*a*)-9(*d*) are drawings for showing the sequential steps through which the molds for the formation of the electrical contact are separated from the drum supporting frame (sub-frame) of the process cartridge in the first embodiment.

Next, referring to FIGS. 4, 5, 6, 8, 9, 10, 11 and 14, the method for forming the contacting surface 19*a* and charge roller contact point 19*b* is described. FIGS. 8(*a*)-(*d*) are perspective view of the combination of the drum supporting frame 13, and molds 27 and 28, which show the sequential steps through which the molds 27 and 28 are attached to the drum supporting frame 13. FIGS. 9(*a*)-9(*d*) are perspective views of the combination of the drum supporting frame 13 and the molds 27 and 28, which show the sequential steps through which the molds 27 and 28 are separated from the drum supporting frame 13. The electrical contact 19 is molded of the electrically conductive resin 34, as an integral part of the drum supporting frame 13, by the injection of the electrically conductive resin 34 into the space formed between the drum supporting frame 13 and mold 27.

To begin with, referring to FIG. 8(*a*), the mold 28 is attached to the drum supporting frame 13 (from direction indicated by arrow mark in FIG. 8(*a*)). During this process, the surface 28*a* of the mold 28 meets the surface of the drum supporting frame 13, which has the resin inlet 13*d*. Next, referring to FIG. 8(*b*), the mold 27 is attached to the drum supporting frame 13 (from direction indicated by arrow mark in FIG. 8(*b*)). During this process, the surface 27*a* of the mold 27 meets the surface 13*e* of the drum supporting frame 13, in such a manner that the rib 13*k* enters the recess 27*c* of the mold 27. Further, a drum supporting frame backing member 37 (which will be referred to simply as backing member, hereafter) is made to meet the opposite side of the drum supporting frame 13 from the resin inlet 13*d* and surface 13*e* of the drum supporting frame 13, to prevent the deformation of the drum supporting frame 13 and the like problem. The backing member 37 plays also a role of preventing the problem that when the electrically conductive resin 34 is injected, the drum supporting frame 13 is moved by the pressure applied to the drum supporting frame 13 by the electrically conductive resin 34, in the direction in which the electrically conductive resin 34 is injected (backing of drum supporting frame 13 will be described in detail in Section 10)).

FIG. 8(*c*) shows the combination of the drum supporting frame 13, mold 27, and mold 28 after the attachment of the molds 27 and 28 to the drum supporting frame 13. Referring to FIGS. 5(*a*), 5(*d*) and 10(*a*), when the mold 27 is attached to the drum supporting frame 13, the projection 27*b* of the mold 27 enters the hole (space) 13*g* of the drum supporting frame 13, leaving a gap between itself and drum supporting frame 13. This gap is the space 20*b* for forming the spring seat. The hole 13*g* is a through hole in the lengthwise end wall of the drum supporting frame 13 which will have the electrical contact 19. Next, referring to FIGS. 6 and 11(*a*), a space which would remain if the rib 13*k* were removed from the space made up of the electrical contact formation space 13*a* of the drum supporting frame 13 and the recess 27*c* of the mold 27 is the space 20*a* for contacting surface 19*a*.

Next, referring to FIG. 8(*d*), after the attachment of the molds 27 and 28 to the drum supporting frame 13, the gate 30 for injecting the electrically conductive resin 34 is inserted into the hole 28*b* of the mold 28. As the gate 30 is inserted, it comes into contact with the deepest end of the hole 28*b*. Incidentally, the gate 30 may be formed as an integral part of the mold 28. In such a case, the mold 27 is attached to the drum supporting frame 13 before the mold 28. Moreover, the mold 28 may be eliminated. In such a case, the gate 30 is directly inserted into the resin injection opening 13*d* of the drum supporting frame 13. Further, the tip of the gate 30 may be provided with a fringe wall (sealing wall) which airtightly meets the surface 13*d* of the drum supporting frame 13, which has the resin injection opening 13*d* so that the joint between the tip and the resin injecting hole 13*d* will remain airtightly sealed when the electrically conductive resin 34 is injected.

Next, referring to FIG. 14(*b*), the electrically conductive resin 34 is injected into the tunnel-shaped runner 13*c* of the drum supporting frame 13 through the resin injection opening 28*b*. Then, the electrically conductive resin 34 advances through the tunnel-shaped runner 13*c* of the drum supporting frame 13, and reaches a fork 13*h* of the runner 13*c*. Then, a part of the body of resin electrically conductive resin 34 flows into the spring seat formation space 13*b* of the drum supporting frame 13, the rest advances further through the tunnel-shaped runner 13*c*, reaching thereby the contact surface formation space 13*a* of the drum supporting frame 13. Therefore, the contact surface formation space 20*a* and spring seat formation space 20*b* are filled up with the electrically conductive resin 34.

FIG. 14(*c*) is a perspective/sectional view of the combination of the drum supporting frame 13, backing member 37, mold 28, gate 30, and body of electrically conductive resin 34 after the injection of the electrically conductive resin 34 into the contact surface formation space 20*a* and spring seat formation space 20*b* has just been completed. Next, referring to FIGS. 4 and 14(*c*), as the injection of the electrically conductive resin 34 is completed, the molds 27 and 28 are separated from the drum supporting frame 13, there appear the contacting surface 19*a* formed by the body of the electrically conductive resin 34 which entered into the contact surface formation space 20*a*, and charge roller contact point 19*b* formed by the body of electrically conductive resin 34, which entered into the spring seat formation space 20*b*. The contacting surface 19*a* and charge roller contact point 19*b* are formed as integral parts of the drum supporting frame 13 by the bodies of electrically conductive resin 34 which enter the two spaces 20*a* and 20*b* through the above described routes (runner 13*c*). As for the aforementioned rib 13*k*, it remains within the electrical contact 19. Further, referring to FIG. 5, the tunnel-shaped runner 13*c*, which extends between the resin injection opening 13*d* of the drum supporting frame 13 to the contacting surface formation space 13*a* is within the wall of the drum supporting frame 13.

Next, referring to FIG. 9, the process for separating the molds 27 and 28 from the drum supporting frame 13 is described. To begin with, referring to FIG. 9(*a*), the gate 30 is retracted from the resin injection opening 28*b* of the mold 28 (direction indicated by arrow mark in FIG. 9(*a*)). Next, referring to FIG. 9(*c*), the mold 27 and backing member 37 are separated from the drum supporting frame 13 (direction indicated by arrow mark in FIG. 9(*c*)). Lastly, referring to FIG. 9(*d*), the mold 28 is separated from the drum supporting frame 13 (direction indicated by arrow mark in FIG. 9(*d*)), exposing the electrical contact 19 (having contacting surface 19*a*, charge roller contact point 19*b*) formed as an integral part of the drum supporting frame 13.

In the case where the mold 28 is not used, the gate 30 is retracted from the drum supporting frame 13 after the injection of the electrically conductive resin 34. Then, the mold 27 and backing member 37 are retracted in the listed order. With the use of the above described method, the electrical contact 19 (having contacting surface 19*a*, charge roller contact point 19*b*) can be formed as an integral part of the drum supporting frame 13.

Figure 12:
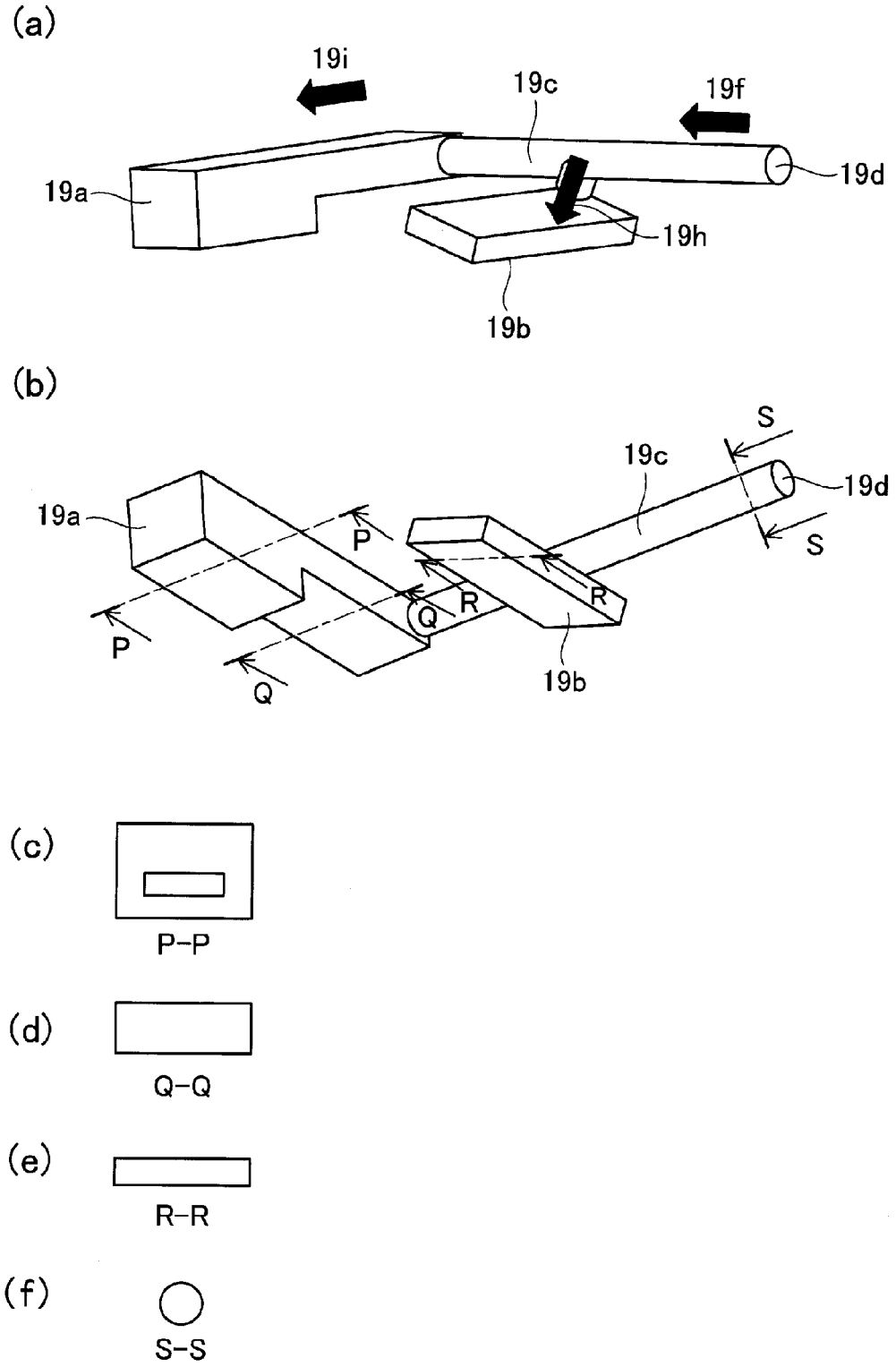
FIGS. 12(*a*)-12(*b*) are perspective views of the electrical contact of the process cartridge in the first embodiment, after the separation of the molds from the contact.

(9) Shape, Function and Electrical Resistance of Each Point (Surface) of Contact Next, referring to FIGS. 5, 12 and 13, the shape of the electrical contact 19 is described. FIGS. 12(*a*) and 12(*b*) are drawings for describing the functions of the electrical contact 19 having appeared as the molds 27 and 28 are separated from the drum supporting frame 13. FIGS. 12(*a*) and 12(*b*) do not show the drum supporting frame 13. FIG. 12(*c*) is a sectional view of the electrical contact 19 at a plane which coincides with a line P-P in FIG. 12(*b*). FIG. 12(*d*) is a sectional view of the electrical contact 19 at a plane which coincides with a line Q-Q in FIG. 12(*b*). FIG. 12(*e*) is a sectional view of the electrical contact 19 at a plane which coincides with a line R-R in FIG. 12(*b*). FIG. 12(*f*) is a sectional view of the electrical contact 19 at a plane which coincides with a line S-S in FIG. 12(*b*). FIGS. 13(*a*) and 13(*b*) are similar to FIGS. 12(*a*) and 12(*b*), respectively, except that FIGS. 13(*a*) and 13(*b*) show the main assembly electrode 21, compression spring 22*a*, and charge roller terminal 23*a*.

Referring to FIGS. 12(*a*) and 12(*b*), the electrical contact 19 has the contacting surface 19*a* and charge roller contact point 19*b*. Next, referring to FIGS. 13(*a*) and 13(*b*), as the process cartridge B is installed into the main assembly 100 of the image forming apparatus A, the contacting surface 19*a* comes into contact with the main assembly electrode 21. Then, as the charge roller 18 is attached to the drum supporting frame 13, the metallic charge roller axle 18*a* comes into contact with the charge roller terminal 23*a*, and the charge roller 18 is rotatably supported by the drum supporting frame 13.

Thus, an electricity passage is established between the main assembly electrode 21 and metallic charge roller axle, by the compression spring 22*a* (which is in contact with the charge roller terminal 23*a*), charge roller contact point 19*b* (which is in contact with the compression spring 22*a*), runner section 19*c*, and contacting surface 19*a*. The surface of the electrical contact 19, which comes into contact with the main assembly electrode 21 does not need to be the contacting surface 19*a*. For example, it may be the surface 19*e*.

Next, the cross-sectional shape of the portion of the electrical contact 19, which corresponds in position to the runner 13*c* of the drum supporting frame 13 is described. Referring to FIGS. 5(*c*), 5(*d*) and 5(*e*), and FIG. 12, the electrical contact 19 (having contacting surface 19*a* and charge roller contact point 19*b*) is different in cross-sectional shape from the runner section 19*c*. Here, the "cross-sectional shape" means the shape of the cross section of the runner section 19*c* at a plane which coincides with the lines P-P, Q-Q, R-R or S-S shown in FIG. 12(*b*), for example. That is, in this embodiment, the cross sections of the electrical contact 19, at planes corresponding to lines P-P, Q-Q, R-R and S-S in FIGS. 12(*c*)-12(*f*), are different in shape. Further, the direction in which the electrically conductive resin 34 flows in the runner 13*c* from gate 30, is different from the directions 19*h* and 19*i* in which the electrically conductive resin 34 flows out of the runner 13*c* to form the contacting surface 19*a* and charge roller contact point 19*b*.

Therefore, the runner section 19*c* becomes different in the distribution of electrically conductive substance in the electrically conductive resin 34 from the contacting surface 19*a* and charge roller contact point 19*b*. In other words, in this embodiment, the electrical contact 19 (electrical contact formation mold) is designed to make the electrically conductive resin 34 change in direction as the electrically conductive resin 34 flows through the runner 13*c* and electrical contact formation space (mold), so that the electrically conductive substance in the electrically conductive resin 34 is disturbed (stirred) as it flows through the runner 13*c* and electrical contact formation space. If the electrical contact 19 is formed of the electrically conductive resin 34 when the resin 34 is nonuniform in the distribution of the electrically conductive substance, it is possible that the resultant electrical contact 19 will be higher in electrical resistance (resistance value, hereafter) than intended. In this embodiment, however, the electrically conductive substance in the electrically conductive resin 34 is prevented from being unevenly settling in the electrically conductive resin 34 as described above. Therefore, its electrical resistance remains as intended; it remains at an intended level. Here, the "orientation" of the flow of the electrically conductive resin 34 means the direction in which the electrically conductive resin 34 flows, and also, the directions in which the body of electrically conductive resin 34 expands, as the electrically conductive resin 34 accumulates in the electrical contact formation space.

Generally speaking, while a body of electrically conductive resin cools to solidify after its injection into a given space, the electrically conductive particles (carbon black particles, which will be described later) in the resin move into the portion of the resin, which is slower to lose heat than the rest (peripheral portion in terms of cross section). Thus, the surface layer of the body of electrically conductive resin 34 reduces in the amount of electrically conductive particles. For example, in a case where a cylindrical component, which is uniform in terms of the diameter, is formed of resinous compound which contains electrically conductive particles, the particles tend to collect in the center portion of the cylindrical component, regardless of the lengthwise direction of the component (direction parallel to generatrix of cylindrical component). In other words, the surface layer of the cylindrical component tends to reduce in the amount of electrically conductive particles. Thus, the resultant cylindrical component is higher in overall electrical resistance than intended. Further, in terms of the direction of the flow of resinous resin, the contacting surface 19*a* and charge roller contact point 19*b* are on the downstream side of the gate 19*d*.

In this embodiment, the runner 13*c* of the drum supporting frame 13, through which the electrically conductive resin 34 is injected into the contacting surface formation space 20*a* and charge roller contact point formation space 20*b*, is designed so that as the resin flows through the runner 13*c*, it is made to change in direction not only in terms of the primary direction, that is, the direction in which it advances, but also, in the secondary direction, that is, the direction perpendicular to the primary direction, by providing the runner 13*c* with bends and/or portions which are different in size in terms of cross section. Therefore, the electrical contact 19 in this embodiment is significantly more uniform in the distribution of the electrical conductive particles, being therefore better in electrical conductivity, than any of electrical contact made of electrically conductive resin, which is in accordance with the prior art. Further, forcing the electrically conductive resin 34 to change in orientation, in terms of the direction in which it is flows, changes the body of electrically conductive resin 34 in terms of which portions of the body of electrically conductive resin is slow to cool. Thus, forcing the electric conductive resin 34 to change in the direction in which it flows and/or expands can make a greater amount of electrically conductive particles in the electrically conductive resin 34 remain in the surface layer, that is, the functional layer, of the electrical contact 19 while the electrical contact 19 cools after its formation. That is, it can provide an electrical contact, the functional portions of which are as small as possible in electrical resistance.

Figure 1:
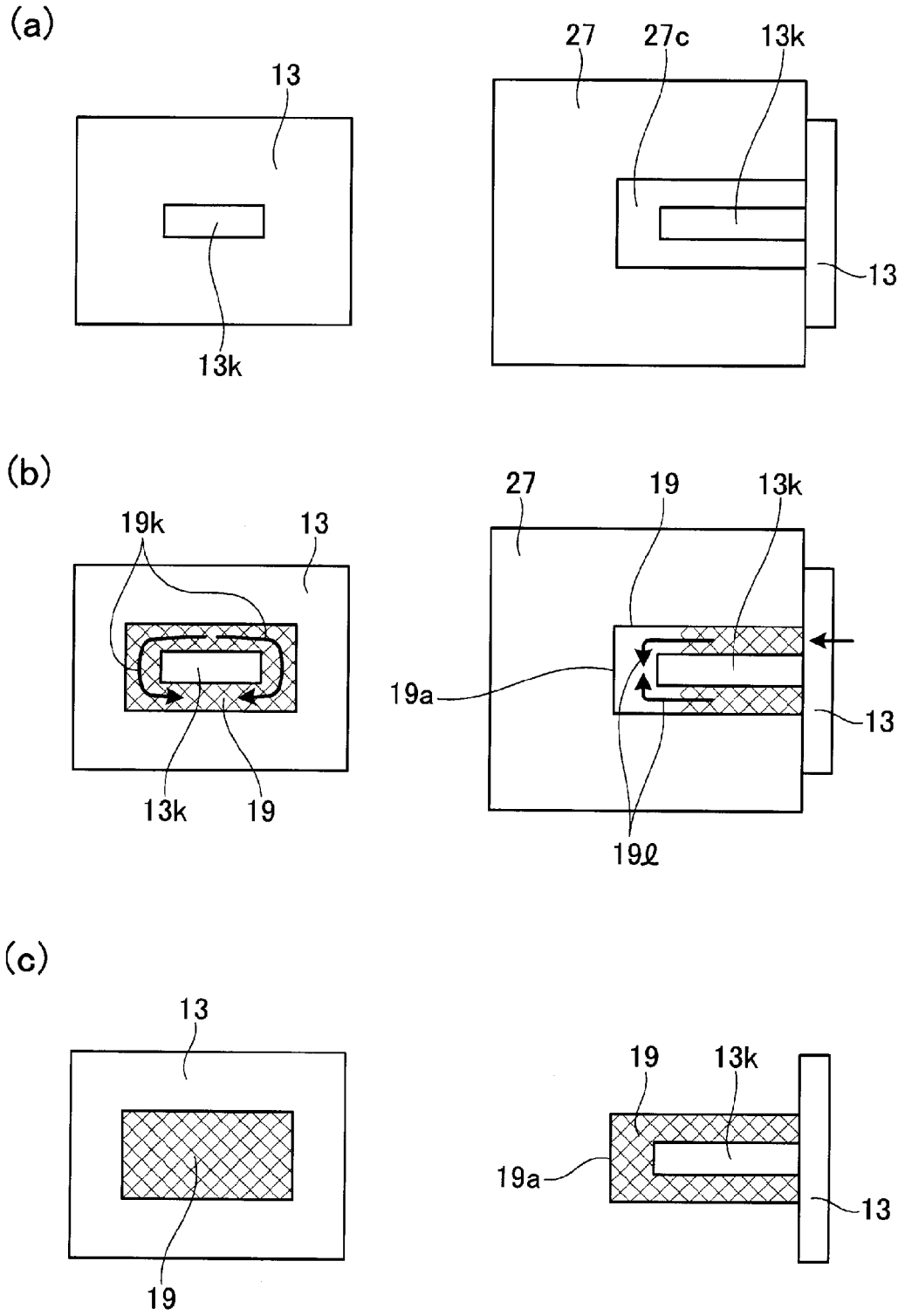
FIGS. 1(*a*)-1(*c*) are sectional views of the combination of the drum supporting frame, electrical contact formation mold, and electrically conductive resin (electrical contact) in the first embodiment of the present invention, and shows the sequential steps for forming the electrical contact in such a manner that the electrical contact envelops the rib with which the drum supporting frame is provided.

Further, in this embodiment, in order to make the electrical contact 19 even better in electrical conductivity, the drum supporting frame 13 is provided with the rib 13*k*. Thus, the benefit of providing the drum supporting frame 13 with the rib 13*k* is described next. FIG. 1 is a drawing for describing the sequential steps through which the electrical contact 19 is formed in such a manner that the rib 13*k* is enveloped by the electrically conductive resin 34. In FIGS. 1(*a*)-1(*c*), the left drawing is the cross-sectional view of the electrical contact 19 as seen from the front side of the apparatus, and the right drawing is the sectional view of the electrical contact 19 as seen from the direction perpendicular to the axial line of the photosensitive drum 7. More specifically, the left drawing of FIG. 1(*a*) is a plan view of the rib 13*k* of the drum supporting frame 13 and its adjacencies, and the right drawing is a sectional view of the combination of the mold 27 and the portion of the drum supporting frame 13, which has the rib 13*k*, at a plane parallel to the axial line of the drum 7 after the attachment of the mold 27 to the drum supporting frame 13. When the combination is in the state shown in FIG. 1(*a*), the rib 13*k* is within the recess 27*c* of the mold 27. FIG. 1(*b*) shows the body of electrically conductive resin 34 which is flowing in the recess 27*c* of the mold 27 around the rib 13*k*. The electrically conductive resin 34 flows in the direction indicated by arrow marks 19*k* and 19*l* in FIG. 1(*b*), while filling the recess 27*c*. FIG. 1(*c*) is a drawing which shows the recess 27*c* of the mold 27 after the recess 27*c* was filled up with the electrically conductive resin 34, that is, after the electrical contact 19 was formed in the recess 27*c*.

As described above, in a case where the drum supporting frame 13 and mold 27 are structured so that as they are joined, the rib 13*k* of the drum supporting frame 13 protrudes into the recess 27*c* (space for forming contacting surface 19*a*, which is at the inward end of the runner 13*c*, the electrically conductive resin 34 flows in a manner to envelop the rib 13*k* (in directions indicated by arrow marks 19*k* and 19*l*). That is, the directions in which the electrically conductive resin 34 flows in the recess 27*c* are different from the one (indicated by arrow mark 19*i*) in which the electrically conductive resin 34 flows before it enters the recess 27*c*. In other words, the electrically conductive resin 34 is stirred even in the recess 27*c*, being thereby disturbed in terms of the distribution of the electrically conductive particles. Also in this embodiment, the rib 13*k* causes the body of the electrically conductive resin 34 to branch at the rib 13*k*, and then, rejoin at the downstream side of the rib 13*k*. Thus, the electrically conductive resin 34 is made even more disturbed (homogenous) in terms of the distribution of its electrical conductive particles. Referring to FIG. 1(*b*), as a body of electrically conductive resin 34 is flowed into the recess 27*c*, it is allowed to flow in various directions different from the direction in which it flowed into the recess 27*c*, in such a manner to envelop the rib 13*k*: it is made more homogenous in terms of the distribution of the electrically conductive particles.

Further, the electrical contact 19 formed with the presence of the rib 13*k* in the recess 27*c* of the mold 27 is different from an electrical contact (19) formed without the rib 13*k* in the recess 27*c*, in the locations which are slower in the speed with which they reduce in temperature while the electrical contact (19) cools. More specifically, in the case where the rib 13*k* is not present in the recess 27*c*, the center portion of the contacting portion 19*a* is slower in cooling speed than the peripheral portion. Therefore, it is possible that the electrically conductive particles will congregate into the center portion (portion which does not come into contact with main assembly electrode), reducing thereby the surface layer of the contacting portion 19*a* in the amount of the electrically conductive particles. In comparison, in the case where the rib 13*k* is present in the recess 27*c*, the center portion of the contacting portion 19*a*, that is, the portion of the contacting portion 19*a*, which is next to the rib 13*k*, is faster in cooling speed than the center portion of the contacting portion (19*a*) formed without the rib 13*k*. Therefore, the contacting portion 19*a* is practically uniform in cooling speed. Therefore, the electrically conductive particles are unlikely to concentrate in the center portion, that is, it is unlikely for the surface layer to become significantly smaller in the amount of the electrically conductive particles.

As described above, in this embodiment, the drum supporting frame 13 and mold 27 are structured so that as the drum supporting frame 13 and mold 27 are joined, the rib 13*k* of the drum supporting frame 13 will protrude into the recess 27*c* of the mold 27, that is, the contacting portion formation space, which is in connection to the inward end of the runner 13*c* of the drum supporting frame 13. Therefore, the electrical contact 19 in this embodiment is significantly more even in the distribution of the electrical conductive particles, being therefore lower in electrical resistance and therefore, better in conductivity, than any electrical contact (19) designed and formed in accordance with the prior art. Further, in the case of the electrical contact 19 in this embodiment, the electrical contact 19 envelops the rib 13*k* of the drum supporting frame 13. Thus, the rib 13*k* reinforces the electrical contact 19, preventing the problem that it is made to collapse by its contraction which occurs after its formation and/or breaks away with the mold 27 when the mold 27 is separated from the drum supporting frame 13. Therefore, the electrical contact 19 in this embodiment is significantly higher in positional accuracy than any conventional electrical contact (19), which protrudes from the drum supporting frame 13 and is formed of electrically conductive resin alone (without rib 13*k*).

In the first embodiment described above, the contacting surface 19*a* and charge roller contact point 19*b* are made different in cross-sectional shape from the runner 13*c* of the drum supporting frame 13, and the drum supporting frame 13 is provided with the rib 13*k*, as shown in FIG. 12. However, if a sole objective is to produce an electrical contact which is significantly more uniform in the distribution of electrically conductive particles, all that is necessary is to provide the drum supporting frame 13 with the rib 13*k*, and for the position the rib 13*k* to protrude into the recess 27*c* of the mold 27. That is, even if it is impossible to design the drum supporting frame 13 so that its runner 13*c* is nonuniform in the width in terms of the direction of the resin flow, an electrical contact (19) which is virtually uniform in the distribution of the electrically conductive particles, being therefore lower in electrical resistance and therefore, better in conductivity, can be obtained by providing the drum supporting frame 13 with such a rib as the rib 13*k* in this embodiment which is positioned as described above. Further, in this embodiment, the rib 13*k* is positioned so that it will be at the downstream end of the runner 13*c* in terms of the direction of the resin flow. However, this embodiment is not intended to limit the present invention in terms of the shape and positioning of the rib 13*k*. All that is required of the rib 13*k* regarding its shape and positioning is that the rib 13*k* is shaped and positioned so that the electrical contact 19 (electricity passage) formed with the presence of the rib 13*k* is significantly smaller in electrical resistance than an electrical contact (19) formed without the presence of the rib 13*k*. For example, the rib 13*k* may be positioned so that it will be within the runner 13*c* (runner section 19*c*: electricity passage between the contacting surface 19*a* and charge roller contact point 19*b*).

(10) Mold Clamping and Backing Up

Next, referring to FIGS. 6, 7, 8, 14 and 15, mold clamping which occurs when the contacting surface 19*a* and charge roller contacting point 19*b* are formed is described. FIG. 15 is a schematic sectional view of the combination of the backing member 37, drum supporting frame 13, electrical contact 19, mold 28, gate 30, and electrically conductive resin 34, which is for describing the resin pressure.

When the electrical contact 19 is formed with the use of the molds 27 and 28, first, the mold 27 is attached to the drum supporting frame 13 in such an attitude that the surface 27*a* of the mold 27 meets the surface 13*e* of the drum supporting frame 13, Then, the mold 27 is clamped to the drum supporting frame 13. Further, the mold 28 is attached to the drum supporting frame 13 in such an attitude that the surface 28*a* of the mold 28 meets the surface 13*f* of the drum supporting frame 13. Then, the mold 28 is clamped to the drum supporting frame 13. More specifically, the backing member 37 is placed in contact with the opposite portion of the drum supporting frame 13 from the surfaces 13*e* and 13*f*, so that the drum supporting frame 13 is backed up by the backing member 37, in order to prevent the surfaces 13*e* and 13*f* of the drum supporting frame 13, being displaced and/or separated from the surfaces 27*a* and 28*a* of the molds 27 and 28, respectively, by the pressure applied to the molds 27 and 28, and/or the pressure P (resin pressure) generated in the electrically conductive resin 34 when the electrically conductive resin 34 is injected into the electrical contact formation space (mold), and also, to prevent the drum supporting frame 13 from being deformed by the pressure P.

In this embodiment, the drum supporting frame 13 is backed up by the backing member 37, by its opposite portions from the surfaces 13*e* and 13*f* of the drum supporting frame 13. However, the portions by which the drum supporting frame 13 is backed up by the backing member 37 do not need to be the portions by which the drum supporting frame 13 is backed up by the backing member 37 in this embodiment. All that is necessary is that the portions of the drum supporting frame 13 by which the drum supporting frame 13 is backed up by the backing member 37 are such portions that can prevent the drum supporting frame 13 from being displaced or deformed. Also in this embodiment, the electrical contact 19 is for providing electrical connection between the charge roller 18 in the latent image forming section D of the process cartridge B, and the main assembly electrode 21. However, this embodiment is not intended to limit the present invention in terms of the role (function) of the electrical contact 19. That is, the present invention is also applicable to an electrical contact which provides electrical connection between the photosensitive drum 7 and the main assembly 100 of the image forming apparatus A, and also, between the charge roller 13 and the main assembly 100. That is, the present invention is also applicable to an electrical contact having a point of contact which provides electrically connection between the charge roller 18 and main assembly 100, and a point of contact which provide electrical connection between the photosensitive drum 7 and main assembly 100. Further, not only is the present invention applicable to the process cartridge (B) structured so that the charge roller 18 and/or photosensitive drum 7 is in electrical connection with the electrical contact 19 through the compression spring 22, or in direct electrical connection to each other. Further, in this embodiment, the electrical contact 19 is a part of the latent image forming section D. However, the present invention is also applicable to the electrical contact (19) of the development section C.

In this embodiment, the material for the electrical contact 19 is polyacetal compound which contains carbon black by 10%. The reason why carbon black is used as electrically conductive material is to minimize the damage (frictional wear and the like) to production apparatuses. However, the substance to be used as the electrical conductive material may be carbon fiber, metallic additive, etc.

Figure 16:
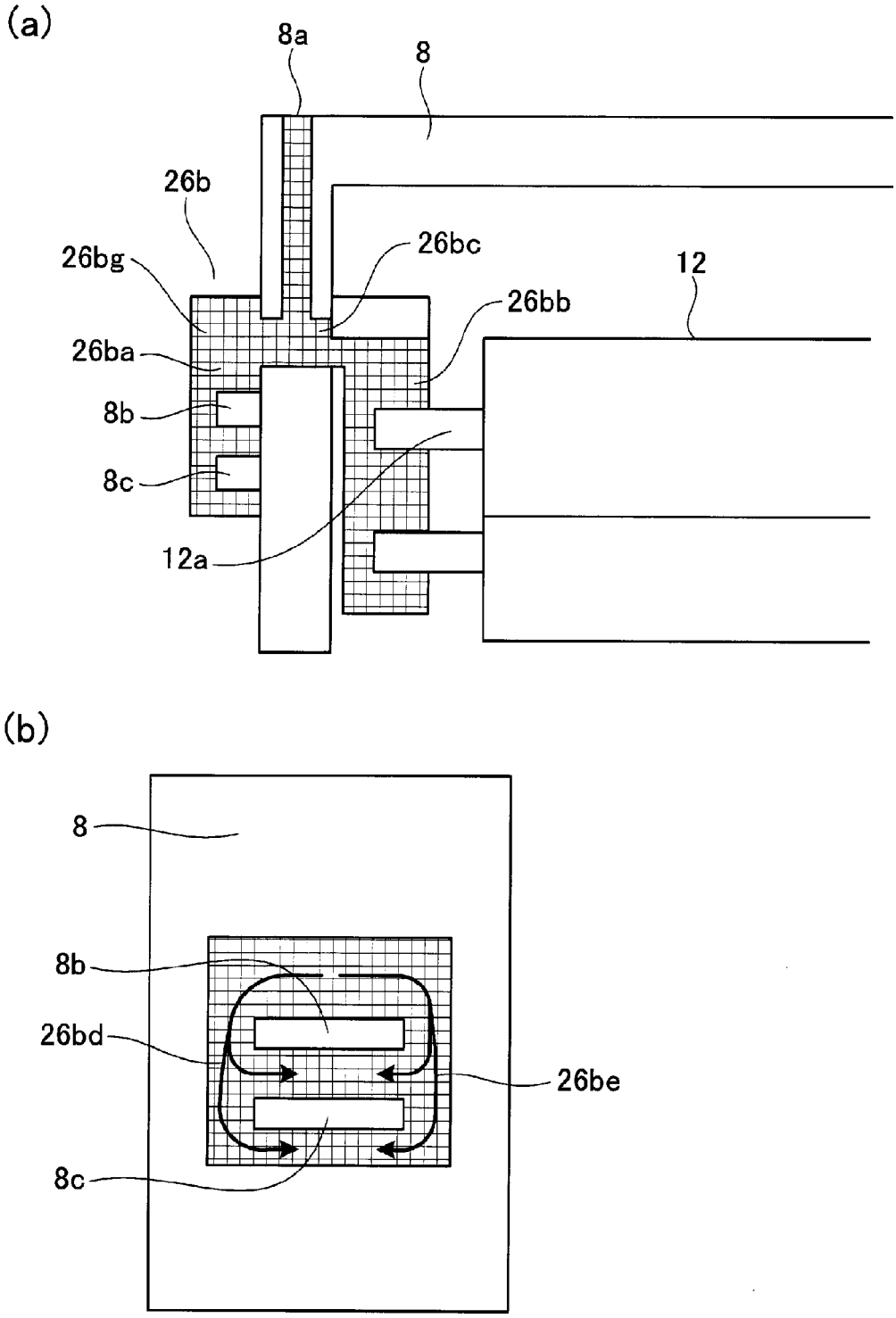
FIG. 16 is a drawing for describing the electrical contact formed of electrically conductive resin, as an integral part of the developing means supporting frame (sub-frame) of the process cartridge.

FIG. 16 is a drawing for describing a case in which an electrical contact 26 is formed as an integral part of the frame 8 of the development cartridge. Electrically conductive resin 34 is injected into the electrical contact formation space through a runner 8*a* (gate). The runner 8*a* branches at a fork 26*bc*, into a resin passage which leads into the space for forming a surface 26*ba* which comes into contact with the main assembly electrode 21 of the main assembly 100 of the image forming apparatus A, and a resin passage which leads into a development roller supporting portion 26*bb*. The main assembly contacting portion 26*ba* is at the tip of the projection 26*bg* which projects from the surface of the development cartridge frame 8. The development roller supporting portion 26*bb* is in contact with the metallic core 12*a* of the development roller 12, and rotatably supports the metallic core 12*a* (development roller 12). Thus, electrical connection is provided between the main assembly 100 of the image forming apparatus A and development roller 12 through the main assembly contacting surface 26*ba*, developer supporting portion 26*bb*, and metallic core 12*a* of the development roller 12.

In the case of the electrical contact 26 structured as shown in FIG. 16, as the electrically conductive resin 34 is injected into the electrical contact formation space through the runner 8*a* (gate), the electrically conductive resin 34 is changed in the direction (directions indicated by arrow marks 26*bd* and 26*be* in FIG. 16(*b*)) by multiple (two) ribs 8*b* and 8*c* with which the development cartridge frame 8 is provided. Therefore, it is made to remain as uniform in the distribution of electrical conductive particles as possible. Further, in the case of the electrical contact 26 structured as shown in FIG. 16, the electrical contact 26 is formed as an integral part of the frame 8 of the development cartridge. However, the present invention is also applicable to an electrical contact which is an integral part of a component which supports the development roller 12 or toner supply roller 16. The electrical connection between the development roller 12 and electrical contact 26 may be through the compression spring 22 as that between the electrical contact 19 and the main assembly electrode 21, as described above.

As described above, in this embodiment, the drum supporting frame 13 is provided with the rib 13*k*, and the mold 27 is structured so that the electrically conductive resin 34 will flow in a manner to envelop the rib 13*k*. Therefore, the electrically conductive particles in the electrical contact 19 in this embodiment remain more randomly (uniformly) distributed in the electrical conductive resin 34 than in any electrical conductive contact in accordance with the prior art, which is formed of electrically conductive resin. Therefore, the electrical contact 19 in this embodiment is significantly lower and stable in electrical resistance, and therefore, better in electrical conductivity, than any electrical contact in accordance with the prior art, which is formed of electrically conductive resin and is an integral part of the drum supporting frame 13.

In a case of an electrical contact which projects from the drum supporting frame 13, or development roller supporting frame, in the same direction as the direction in which the mold is removed, if the mold therefor is separated from the drum supporting frame 13 or the like before it sufficiently cools after its formation, it is possible for the electrical contact, or a part of it, to remain adhered to the mold and break off from the mold. Therefore, the electrical contact has to be allowed to cool for a substantial length of time, which adds to production cost. Further, it is possible for the electrical contact to be deformed by its shrinking which occurs when the electrical contact is allowed to naturally cool after its formation. It is also possible that as the process cartridge B is subjected to a substantial amount of impact during its shipment, the electrical contact will break off or separate from the frame to which it belongs.

In comparison, the electrical contact 19 in this embodiment is formed so that it envelops the rib 13*k* of the drum supporting frame 13. Therefore, the rib 13*k* reinforces the electrical contact 19, making it unlikely for the electrical contact 19 to be felled by its contraction which occurs to the electrical contact 19 after its formation, or to be deformed and/or partially separated from the frame 13 when the mold therefor is separated from the drum supporting frame 13, or the like.

That is, this embodiment of the present invention can substantially reduces the length of time necessary to cool the electrical contact, and therefore, can reduce the manufacturing cost for the electrical contact (process cartridge). Further, it can prevent the problem that as a process cartridge is subjected to impact during its shipment, its electrical contact falls off or becomes separated from its base. Further, the electrical contact in this embodiment is, and remains, more accurately positioned than an electrical contact in accordance with the prior art, which is made of the electrically conductive resin 34 alone, that is, without the presence of a projection (13*k*) which projects from the side wall of the drum supporting frame 13.

[Embodiment 2]

Next, referring to FIGS. 17, 18, 19 and 20, the second embodiment of the present invention is described. In the first embodiment described above, the rib which functions as a reinforcement for the electrical contact 19 was an integral part of the drum supporting frame 13. However, in a case where a rib which is made to protrude into the recess 27*c* of the mold 27 is intended only to keep the electrically conductive resin 34 as homogenous as possible in terms of the distribution of the electrically conductive particles, it does not need to be formed as an integral part of the drum supporting frame 13; it may be formed as an integral part of the mold 27.

In this embodiment, the rib is formed as an integral part of the mold 27. In the following description of the second embodiment, only the structural components of the process cartridge B, which are different in structure from the counterparts in the first embodiment, are described; the structural components in the second embodiment which are similar to the counterparts in the first embodiment are not going to be described.

Figure 17:
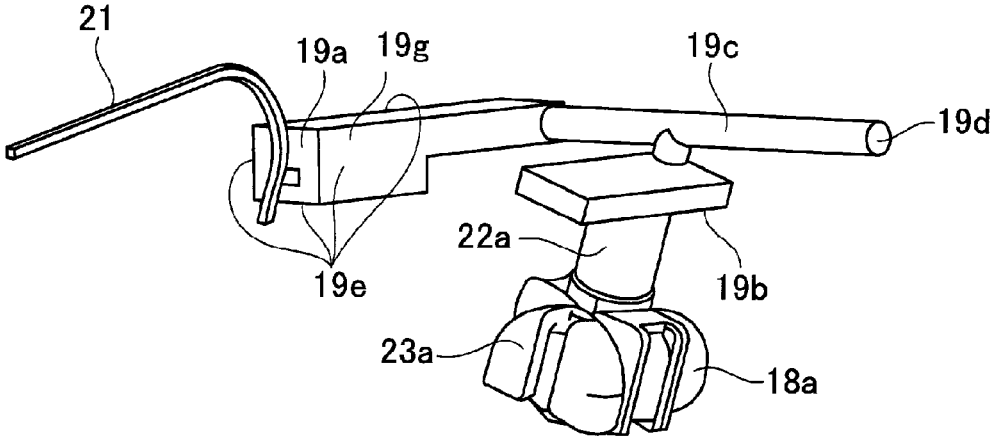
FIGS. 17(*a*) and 17(*b*) are perspective views of the combination of the electrode of the main assembly of the image forming apparatus, and the compression spring and charge roller terminal of the process cartridge, in the second embodiment.
Figure 17:
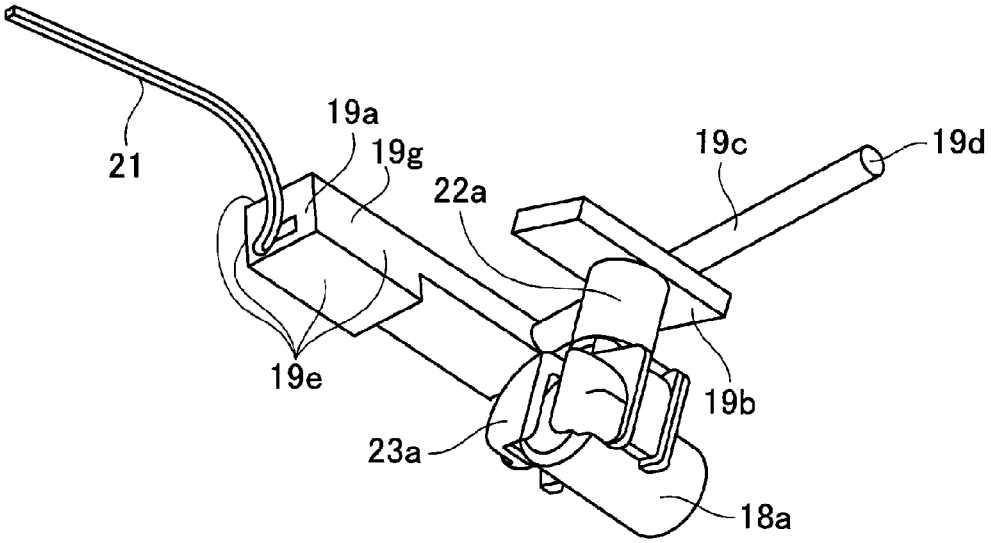
Figure 18:
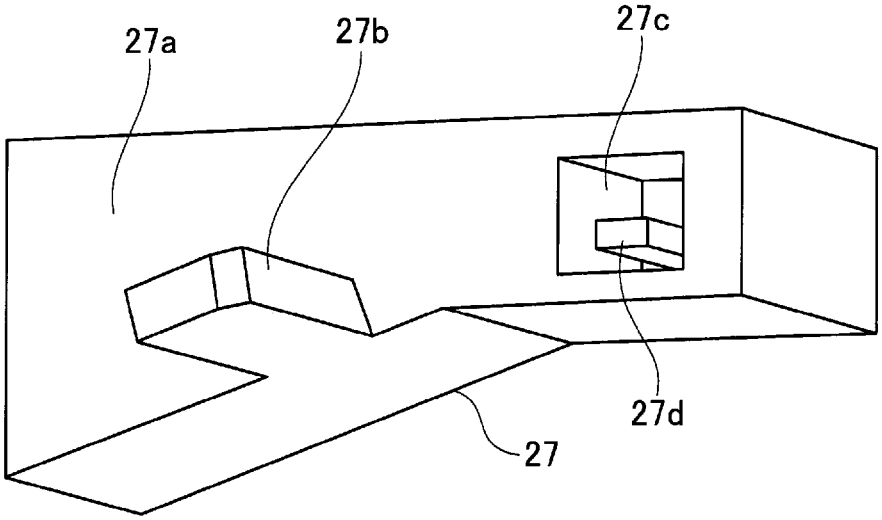
FIG. 18 is a drawing for describing the electrical contact formation mold in the second embodiment.
Figure 19:
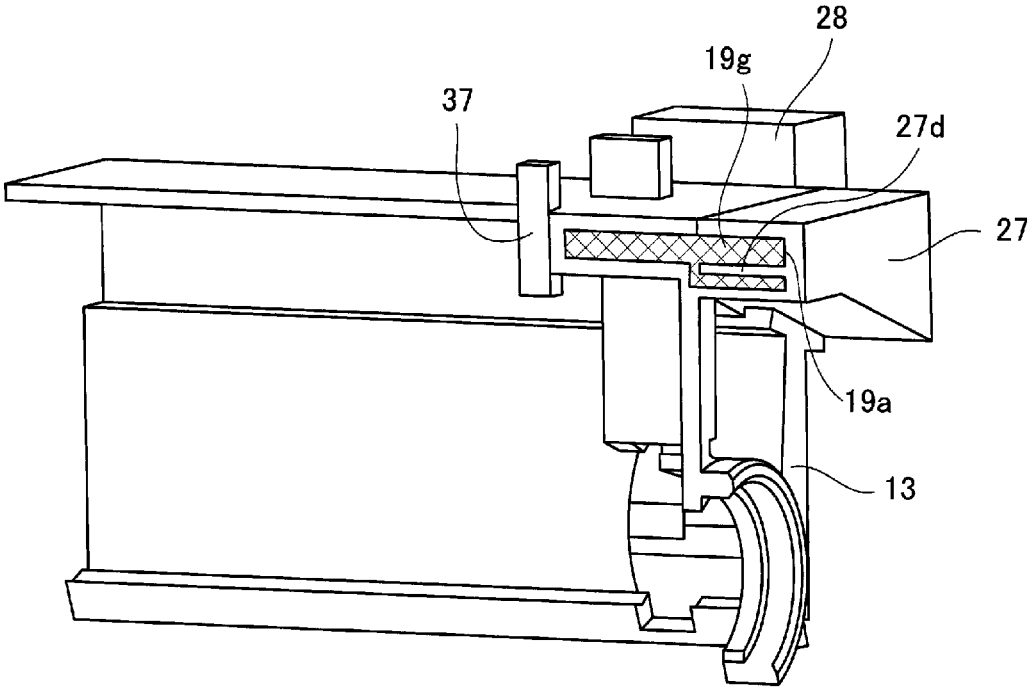
FIG. 19 is a perspective view of the lengthwise end of the drum supporting frame (sub-frame) of the process cartridge in the second embodiment, which has the electrical contacts, after the injection of the electrically conductive resin into the electrical contact formation space in the frame.
Figure 20:
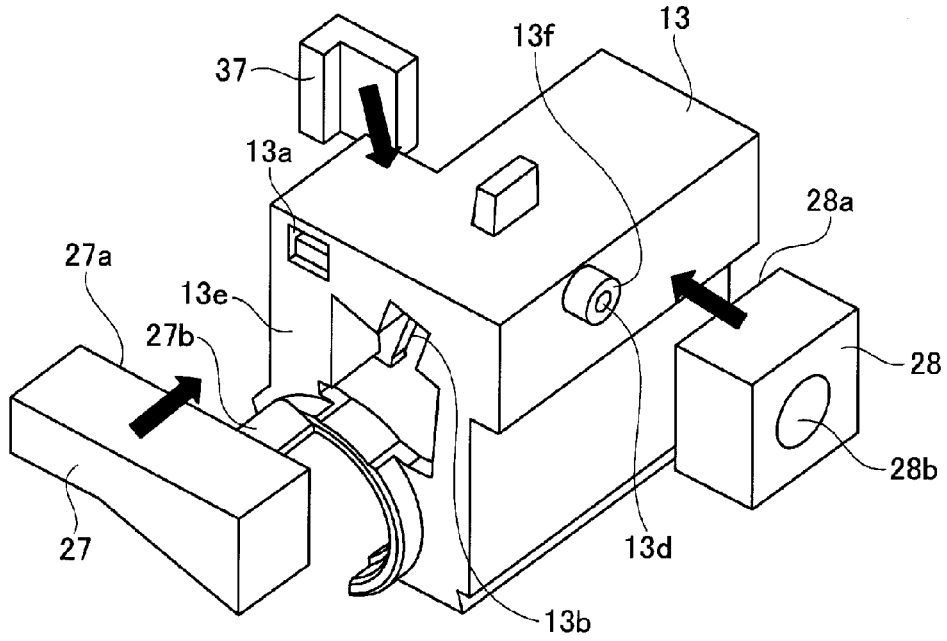
FIG. 20 is a drawing for describing the attachment of the electrical contact formation molds and drum supporting frame (sub-frame) backing member, to the drum supporting frame (sub-frame) of the cartridge in the second embodiment, and their separation of from the drum supporting frame, in the second embodiment.
Figure 20:
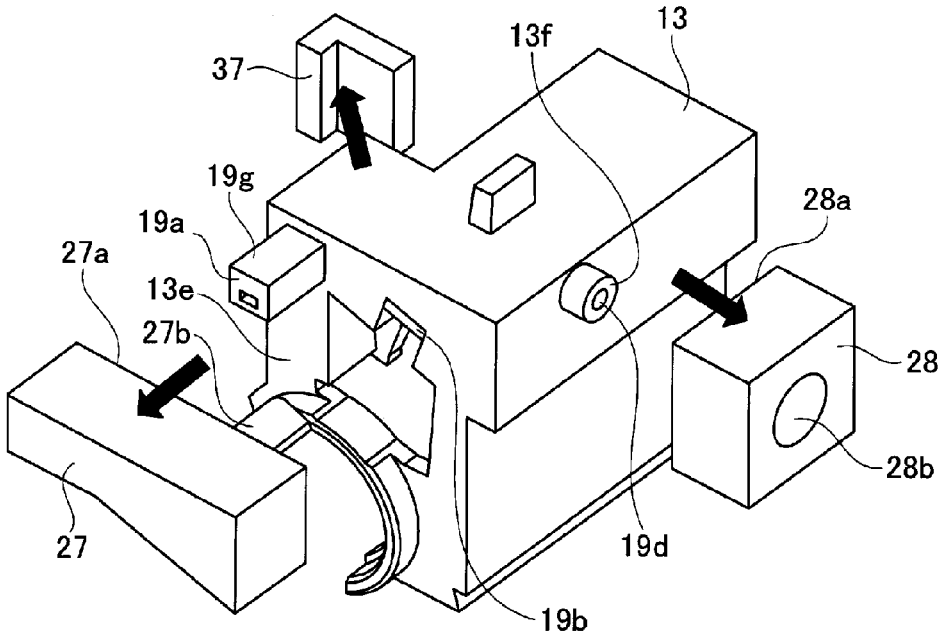

FIGS. 17(*a*) and 17(*b*) are schematic perspective view of the combination of the main assembly electrode 21, compression spring 22*a*, and charge roller terminal 23*a*, in addition of the electrical contact 19 in this embodiment, as seen from the top and bottom sides, respectively, of the combination. FIG. 18 is a perspective view of the mold 27 (electrical contact formation mold) in this embodiment. FIG. 19 is a perspective/sectional view of the combination of the lengthwise end of the drum supporting frame 13, mold 28 (resin injection gate), backing member 37, and electrically conductive resin 34, in the second embodiment, after the injection of the electrically conductive resin into the electrical contact formation space formed between the drum supporting frame 13 and mold 27. FIG. 20(*b*) is a schematic perspective view of the combination of the drum supporting frame 13, mold 27, mold 28, and backing member 37, after the separation of the molds 27 and 28 and backing member 37 from the drum supporting frame 13, which occurred after the injection of the electrically conductive resin 34 (formation of the electrical contact 19).

Referring to FIG. 18, the mold 27 is provided with a rib 27*d*, which protrudes into the recess 27*c* of the mold 27. Next, referring to FIG. 20(*a*), when the electrical contact 19 is formed, the molds 27 and 28, and backing member 37 are placed airtightly in contact with the drum supporting frame 13. Then, the electrically conductive resin 34 is injected into the electrical contact formation space which is formed by the drum supporting frame 13 and mold 27, and into which the rib 27*d* is protruding, as shown in FIG. 19. Then, the molds 27 and 28 and backing member 37 are separated from the drum supporting frame 13, to expose the electrical contact 19 which became an integral part of the drum supporting frame 13*f*, as shown in FIG. 20(*b*).

Referring to FIG. 17, as the process cartridge B is installed into the main assembly 100 of the image forming apparatus A, the contacting surface 19*a*, that is, the end surface of the portion 19*g* of the electrical contact 19, which is protruding from the surface of the drum supporting frame 13, comes into contact with the main assembly electrode 21. Here, the surface of the electrical contact 19, by which the electrical contact 19 comes into contact with the main assembly electrode 21, does not have to be the surface 19*a*. That is, it may be any surface of the electrical contact 19. For example, it may be the surface 19*e* of the electrical contact 19.

As described above, in this embodiment, the electrically conductive resin 34 is changed in the direction in which it flows, by providing the mold 27 with the rib 27*d*. Thus, the electrical contact 19 in this embodiment is significantly more homogenous in the distribution of the electrically conductive particles, being therefore significantly lower in electrical resistance, and therefore, being better in electrical conductivity, than any electrical contact (19) in accordance with the prior art, which are formed of a resinous compound which contains electrically conductive substance (particles). Further, in the preceding embodiment described above, the portion of the electrical contact 19, which contacts the main assembly electrode 21, projects from the surface of the drum supporting frame 13. However, the drum supporting frame 13 and electrical contact 19 may be designed so that the electrical contact 19 projects from the bottom surface of the recess with which the surface of the drum supporting frame 13 is provided.

According to the present invention, it is possible to provide a process cartridge, the electrical contact of which is formed of electrically conductive resin, and is significantly lower in electrical resistance than any electrical contact in accordance with the prior art, which is formed of electrically conductive resin.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 277467/2011 filed Dec. 19, 2011, which is hereby incorporated by reference.

What is claimed is:

1. A cartridge detachably mountable to a main assembly of an image forming apparatus, a cartridge comprising:

an electric energy receiving member;

a frame of resin material; and an electrode member that (i) is molded by injecting electroconductive resin material into said frame and (ii) provides an electroconductive path between said electric energy receiving member and a main assembly electrical contact provided in the main assembly when said cartridge is mounted to the main assembly, said electrode member having a projected portion projected from a surface of said frame for contacting the main assembly electrical contact, and said projected portion being provided by changing a direction of flow of the injected electroconductive resin material by a metal mold or said frame.

2. A cartridge according to claim 1, wherein said projected portion is molded in contact with a frame projection projected from said frame.

3. A cartridge according to claim 2, wherein said projected portion is molded while being surrounded by said frame projection.

4. A cartridge according to claim 3, wherein a plurality of such said frame projection is provided.

5. A cartridge according to claim 1, wherein said projected portion is molded in contact with a metal mold projection projected from the metal mold.

6. A cartridge according to claim 5, wherein said projected portion is molded surrounding the metal mold projection.

7. A cartridge according to claim 1, wherein said electrode member penetrates a hole of said frame.

8. A cartridge according to claim 1, wherein said electric energy receiving member is a charging member for charging an electrophotographic photosensitive member.

9. A cartridge according to claim 1, wherein said electric energy receiving member is a developing member for developing an electrostatic latent image formed on an electrophotographic photosensitive member.

10. A cartridge detachably mountable to a main assembly of an image forming apparatus, said cartridge comprising:

an electric energy receiving member;

a frame of resin material; and an electrode member that (i) is molded by injecting electroconductive resin material into a space between said frame and a metal mold contacted to said frame and (ii) provides an electroconductive path between said electric energy receiving member and a main assembly electrical contact provided in the main assembly when said cartridge is mounted to the main assembly, said electrode member having a cartridge contact portion for contacting the main assembly electrical contact, said cartridge contact portion being provided in contact with a frame projection projected from said frame.

11. A cartridge according to claim 10, wherein said cartridge contact portion is projected from said frame.

12. A cartridge according to claim 10, wherein said cartridge contact portion is molded surrounding said frame projection.

13. A cartridge according to claim 10, wherein a plurality of such said frame projection is provided.

14. A cartridge according to claim 10, wherein said electrode member penetrates a hole of said frame.

15. A cartridge according to claim 10, wherein said electric energy receiving member is a charging member for charging an electrophotographic photosensitive member.

16. A cartridge according to claim 10, wherein said electric energy receiving member is a developing member for developing an electrostatic latent image formed on an electrophotographic photosensitive member.

* * * * *